US007073356B2

(12) United States Patent
Nakamura et al.

(10) Patent No.: US 7,073,356 B2
(45) Date of Patent: Jul. 11, 2006

(54) DRUM TYPE WASHING MACHINE

(75) Inventors: Satoshi Nakamura, Otsu (JP); Tamotsu Kawamura, Yokaichi (JP); Kenji Nakagawa, Kusatsu (JP); Takashi Fukui, Otsu (JP); Makoto Takeuchi, Otsu (JP); Harumi Takeuchi, Otsu (JP); Yorihisa Funada, Yasu-gun (JP); Kunioki Honda, Kusatsu (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 571 days.

(21) Appl. No.: 10/247,520

(22) Filed: Sep. 20, 2002

(65) Prior Publication Data

US 2003/0061841 A1 Apr. 3, 2003

(30) Foreign Application Priority Data

Sep. 28, 2001 (JP) ..... 2001-299095
Feb. 12, 2002 (JP) ..... 2002-033837

(51) Int. Cl.
*D06F 39/14* (2006.01)

(52) U.S. Cl. ..... 68/12.26; 68/139

(58) Field of Classification Search ..... 68/12.26, 68/17 R, 139
See application file for complete search history.

(56) References Cited

U.S. PATENT DOCUMENTS

| | | | | |
|---|---|---|---|---|
| 4,862,712 | A * | 9/1989 | Huttemann | 68/17 R |
| 4,989,761 | A | 2/1991 | Ikeda | |
| 5,398,528 | A * | 3/1995 | Johnston et al. | 68/24 |
| 5,437,168 | A | 8/1995 | Mason et al. | |
| 5,448,900 | A | 9/1995 | Cuthbert et al. | |
| 5,469,593 | A * | 11/1995 | Cuthbert et al. | 8/159 |
| 6,233,981 | B1 * | 5/2001 | Grandpierre | 68/140 |
| 6,343,492 | B1 * | 2/2002 | Seagar et al. | 68/142 |

FOREIGN PATENT DOCUMENTS

| | | |
|---|---|---|
| CN | 1124800 A | 6/1996 |
| DE | 33 46 427 A1 | 7/1985 |
| EP | 1 001 068 A1 | 5/2000 |
| GB | 2 262 595 A | 6/1993 |
| JP | A 4-297298 | 10/1992 |
| JP | A 2000-111229 | 4/2000 |
| JP | A 2001-62194 | 3/2001 |
| JP | A 2002-346281 | 12/2002 |

* cited by examiner

*Primary Examiner*—Joseph L. Perrin
(74) *Attorney, Agent, or Firm*—Oliff & Berridge, PLC

(57) ABSTRACT

In a drum type washing machine, a drum 23 is mounted to rotate about a horizontal axis extending in the lateral direction in a tub 20. A tub opening 20*b* with a tub door 20*a* is formed in the tub 20 under the throw-in opening 3 formed in the front part of the top of the housing. A drum opening 23*a* with a drum door composed of a double door opening frontward and backward is formed in the peripheral wall of the drum 23. The drum 23 is stopped so that the drum opening 23*b* coincides with the tub opening 20*b*. The drum door 23*a*, forced into its opening direction, is held in a closed position by an engagement of a claw 43 and an engagement hole 53. When a user rotates a operation lever 63*b* for latching or unlatching the tub door 20, the drum door open/close mechanism 65 functions to make two rods 65*a* and 65*b* project or withdraw, whereby the drum door 23*a* is brought into an engaged or unengaged state. By this mechanism, the drum door 23*a* opens or closes with the opening or closing operation of the tub door 20*a*. Thus, the operation of the doors is simplified, and the laundry loaded into or unloaded out of the drum 23 by fewer working steps.

16 Claims, 20 Drawing Sheets

DRUM TYPE WASHING MACHINE

The present invention relates to a drum type washing machine having a drum rotated about a horizontal or inclined axis. The drum type washing machine hereby may be one that is constructed to continuously perform the dual processes of washing to drying, like many commonly available drum type washing machines.

BACKGROUND OF THE INVENTION

A drum type washing machine has an outer tub, simply referred to as "a tub" hereinafter, in which a cylindrical basket drum is mounted to rotate about a horizontal or inclined axis. With the laundry loaded inside, the drum is rotated in the tub containing water. The drum thus rotating makes the laundry tumble, whereby the stain or the like is removed from the laundry. Well known conventional drum type washing machines have a substantially rectangular parallel-piped housing equipped with a front door that opens laterally to put clothes in. When the door is opened, a throw-in opening provided at an end of the drum becomes visible through an opening provided in the tub.

About the above drum type washing machine, many consumers are dissatisfied because of the difficulty in loading or unloading clothes. In drum type washing machines with the above structure, the throw-in opening is located very low. With this design, the difficulty in loading or unloading clothes cannot be completely eliminated even by placing the washing machine on a dedicated platform. Considering the above complaint, some drum type washing machines have a drum with an inclined axis to make the throw-in opening directed obliquely upward. In other washing machines, the throw-in opening is designed larger. These structures, however, cannot yield a satisfactory result for those who are accustomed to the user-friendly whirl type washing machines. Another problem is related to the following washing method often carried out by consumers: (1) put the laundry in a solution of bleach or the like stored in a bucket or the like, and (2) transfer the laundry with the solution of bleach, or only the laundry, to the washing tub of the washing machine. With the conventional drum type washing machine, the laundry often drips the liquid onto the floor when only the laundry is transferred from the bucket to the washing tub. Furthermore, it is very difficult to transfer the liquid itself from the bucket to the washing tub.

One possible method for eliminating the above user-unfriendly drum type washing machine is to form the throw-in opening not in the front but in the top of the housing, as in the case of whirl type washing machines. To form the throw-in opening in the top of the housing, however, it is necessary to form openings also in the tub placed right under the throw-in opening and in the drum enclosed in the tub. Such a structure causes various problems that do not occur in conventional whirl type washing machines or drum type washing machines. Examples of the problems are as follows:

(1) To load or unload the laundry into and out of the drum, it is necessary to open at least two doors: a tub door provided in the peripheral wall of the tub, and a drum door provided in the peripheral wall of the drum. For user-friendliness, it is desirable to design these doors easy to operate.

(2) To avoid damaging clothes in the course of opening or closing the door, it is desirable, for example, to prevent the laundry from getting caught by the door.

(3) The drum is not usually large enough to form a large opening in its peripheral wall. Despite such a constraint, the loading or unloading of the laundry should be as easy as possible.

(4) Measures should be taken to prevent the laundry from falling into the space between the tub and the drum.

SUMMARY OF THE INVENTION

In view of the above problems, the main object of the present invention is to improve the user-friendliness of drum type washing machines, which are conventionally said to be inferior to whirl type washing machines in respect of user-friendliness.

Thus, the present invention proposes a drum type washing machine in which a drum with a substantially cylindrical peripheral wall is mounted to rotate about a horizontal or inclined axis in a tub enclosed in a housing, which further includes:

a) a throw-in opening formed in the top of the housing, which can be closed by a lid;

b) a tub opening formed in the peripheral wall of the tub placed right under the throw-in opening, which can be closed by a tub door;

c) a drum opening formed in the peripheral wall of the drum, which can be closed by a drum door;

d) a drum position determiner for stopping the drum in such a position that the drum opening substantially coincides with the tub opening; and e) a door-linking mechanism for making the drum door open with an opening motion of the tub door when the drum is stopped with both the tub door and the drum door closed.

By the above washing machine (which is referred to as "the first washing machine" hereinafter), when the drum is stopped, the drum position determiner controls the drum to come to such a position that the drum opening substantially coincides with the tub opening.

In this position, when a user opens the lid and then opens the tub door, the door-linking mechanism makes the drum door open with the opening motion of the tub door. By this operation, there is no need to open both doors separately. When the outer door is opened, the inner door is simultaneously opened. Similarly, when the outer door is closed, the inner door is simultaneously closed. The operation is, therefore, halved in time and stages, thus reducing the operation to maximum simplicity.

In a preferable construction, the drum door is forced into its opening direction by a force whose magnitude is determined so that the force makes the drum door barely follow the opening motion of the tub door. Here "barely" means that the force must be determined moderately. If the force is too strong, the drum door jumps up and abruptly opens the tub door at the moment when the drum door is unlocked. This might make the tub door hit the hand of the user. If the force is too weak, the drum door moves so little that the user may not recognize that the drum door is open even after it is unlocked. Or the drum door is still half-closed after the user has opened the tub door. By the above construction, the force actuates the drum door to push the tub door slightly up when the drum door is unlocked, and to open the drum door following the opening motion of the tub door when the user opens the tub door. Because of this construction, the user can open and close the doors safely and with great ease of handling.

The first washing machine may be constructed as follows: the drum is mounted to rotate about an axis extending in the lateral direction; the housing has a slope declining from the top to the front; the throw-in opening is formed to extend over the slope; the lid is a foldable structure composed of at least a front part and a rear part which are hinged to each other at a bent part of the top of the housing, where the bent part corresponds to the rear end of the slope; and the lid stands behind the throw-in opening in a folded position when it is opened. By such a construction, the lid is thinly folded and does not project frontward when standing behind the throw-in opening. This design of the lid assuredly prevents the lid from obstructing the loading or unloading of the laundry. When the tub door is constructed to open backward, the lid of the above design will never obstruct the opening motion of the tub door. Further, the lid of the above design can easily be opened by a user who is not so tall.

The first washing machine may be preferably constructed as follows: the drum is mounted to rotate about an axis extending in the lateral direction; the housing has a slope declining from the top to the front; the throw-in opening is formed to extend over the slope; and an control panel with control keys is placed on the slope. With still more preferable construction, the lid for closing the throw-in opening, the control panel with the control keys and a detergent container which is drawable frontward are arranged so that the lid is located at the center, and the control panel and the detergent container are located on both sides of the lid, respectively, or on one side of the lid only.

This construction is based on the idea that one method for eliminating the user-unfriendliness of the drum type washing machine is to provide the throw-in opening not in the front but in the top of the housing, as in the case of conventional whirl type washing machines. By the above construction, not only the throw-in opening is formed in the top of the housing, but it is also formed to cover a part of the slope that declines from the top to the front. This design allows users to load or unload the laundry in a comfortable position with no difficulty. It should be noted that the formation of the slope can improve the user-friendliness without decreasing the laundry capacity, because the slope is formed using only a dead space existing at the corner of the housing between the top and front walls of the housing and the peripheral wall of the drum when the drum is mounted to rotate about an axis extending in the lateral direction.

In addition, by the above construction, the control panel is placed on the slope of the housing and is directed obliquely upward. This design allows users to almost directly face the control panel in a comfortable position with no difficulty. Therefore, for example, the user can easily read the explanations of the control keys on the panel, and can easily operate the keys. It is also preferable to place on the slope various display devices for showing the progress of the washing operation or the remaining time. This design allows users to look at the display almost directly, so that the display can be seen very clearly even if it uses light emitting diodes (LED) or liquid crystal display (LCD), which is hard to see when obliquely viewed.

Also, by the above construction, the user does not need open the lid to put the detergent into the detergent container and to operate the keys of the control panel. When the lid is constructed to open backward, the lid in the opened position does not hide the control panel and the detergent container. Thus, the user can put the detergent into the detergent container and operate the keys of the control panel with the lid open.

In a mode of the invention, the first washing machine further includes:

a tub-door-latching mechanism for holding the tub door in the closed position of the tub door;

a forcing mechanism for forcing the drum door in the opening direction of the drum door;

a drum-door-latching mechanism for holding the drum door in the closed position;

an operation mechanism, provided in the tub door, to be operated by a user; and an unlatching mechanism for actuating the tub-door-latching mechanism and the drum-door-latching mechanism in response to an operation of the operation mechanism so that the drum door is released from its latched state and the tub door is released from its latched state at the same time or with little delay.

With this construction, the two latching mechanisms hold the drum door and the tub door in the closed position so that they do not open during the washing operation. To look into the drum for the purpose of loading or unloading the laundry into or out of the drum or for other purposes, the user should first open the lid to make the surface of the tub accessible and then operate the operation mechanism to open the tub door. In response to this operation, the unlatching mechanism actuates the drum-door-latching mechanism to release the drum door from the closed position. At the same time, or with little delay, the unlatching mechanism actuates the tub-door-latching mechanism to release the tub door from the closed position. When released from the closed position, the drum door, being forced into the opening direction, is lifted in such a direction that it finally contacts the inner surface of the tub door. At this moment, the tub door is still closed. When the tub door is released from the closed position, the drum door, lifted as explained above, follows the opening motion of the tub door. By this operation, there is no need to take the following two steps to open the doors: first to open the tub door, then to open the drum door. Thus, the user does not need to do any particular operation to open the drum door, and the loading or unloading of the laundry can be done by fewer working steps.

It is preferable to construct the tub-door-latching mechanism and the drum-door-latching mechanism so that the tub door and the drum door independently move from the opened positions to the closed and latched positions. By this construction, when being closed from the opened positions, the two doors are not linked with each other, so that the user needs first to close the drum door, and then to close the tub door. If the drum door were designed to close together with the closing motion of the tub, there might arise such a trouble that, when the doors are closed, an end of the laundry hanging out of the drum opening gets caught by the drum door closed and is hidden between the drum and the tub without being noticed by the user. By the above construction, on the other hand, the user needs to close the drum door before closing the tub door. Therefore, if the laundry gets caught by the drum door closed, the user hardly fails to see it. Thus, providing adequate user-friendliness, the above construction prevents damaging the laundry or the washing machine itself due to the laundry being caught by the drum door.

The unlatching mechanism may be constructed with the following elements: a first moving part which projects into or withdraws from the inside of the drum together with the operation of the operation mechanism, and contacts the drum-door-latching mechanism to release the latch when it fully projects; and a second moving part which actuates the drum-door-latching mechanism together with the operation of the operation mechanism to release the latch. By this construction, the first and second moving parts work at different timings together with the operation of the operation mechanism. Therefore, the timings for the two latching mechanisms to release the latches can be determined as desired.

In the case where the drum-door-latching mechanism is designed to hold the drum door in the latched position when the tub door is in the latched position, there still remains a possibility that the drum door will open due to abnormal vibration or some other cause while the tub door is closed. If driven under such a condition, the drum rotates with the drum door touching the inner surface of the tub. This situation not only generates abnormal noise but also causes trouble or damage. In view of this problem, the first washing machine may preferably include a stopper which contacts the edge of the drum door when the drum attempts to rotate with the drum door opened. By this construction, when the drum door is unlatched and half-opened by the force while the tub door is closed, the stopper on the inner surface of the tub door contacts the edge of the drum door and prevents the drum from rotating. Under this condition, if the driving of the drum is forcefully continued, the motor for rotating the drum becomes abnormally loaded. Therefore, the abnormal situation can be detected by monitoring the state of the motor. Thus the drum is prevented from rotating under undesirable conditions, and abnormal noises or damage can be prevented.

The present invention further proposes a drum type washing machine wherein a drum with a substantially cylindrical peripheral wall is mounted to rotate about an axis extending in the lateral direction of a tub enclosed in a housing, which further includes:

a) a throw-in opening formed in the top of the housing, which can be closed by a lid;

b) a tub opening formed in the peripheral wall of the tub placed immediately under the throw-in opening, which can be closed by a tub door;

c) a drum opening formed in the peripheral wall of the drum;

d) a drum door for closing the drum opening, composed of a double door having two door elements opening frontward and backward, respectively, each door element being forced into its opening direction, and an engaging mechanism for holding the drum door in the closed position;

e) a drum position determiner for stopping the drum in such a position that the drum opening substantially coincides with the tub opening; and f) a drum-door-linking mechanism having at least one moving part capable of moving back and forth between the tub and the drum, where the moving part makes a motion when an operation to open the tub door is performed, and the motion of the moving part releases the engaging mechanism from engagement so that the drum door is opened.

With the above washing machine (which is referred to as "the second washing machine" hereinafter), when the user opens the tub door, the drum door opens together with the tub door. Therefore, the user does not need to do any particular operation to open the drum door, and the loading or unloading of the laundry can be done with fewer working steps. When opened, the two door elements open frontward and backward, respectively, where the front-side door element is laid frontward and closes the spaces between the drum and the tub and between the tub and the housing. Thus, the laundry is prevented from falling into or getting caught in the space while being loaded or unloaded.

The drum-door-linking mechanism may be constructed so that a closing operation of the tub door makes the moving part move to bring the engaging mechanism into engagement so that the drum door is closed. By this construction, when the tub door is latched or locked in the closed position, the drum door is also closed together with the tub door. Therefore, the user does not need to do any particular operation to close the drum door, and the loading or unloading of the laundry can be done with fewer actions.

The present invention further proposes a drum type washing machine wherein a drum with a substantially cylindrical peripheral wall is mounted to rotate about an axis extending in the lateral direction in a tub enclosed in a housing, which further includes:

a) a throw-in opening formed in the front-side part of the top of the housing, which can be closed by a lid;

b) a tub opening formed in the peripheral wall of the tub placed immediately under the throw-in opening, which can be closed by a tub door;

c) a drum opening formed in the peripheral wall of the drum;

d) a drum door for closing the drum opening, composed of a double door having two door elements opening frontward and backward, respectively, where the length of the front-side door element in the front-back direction is smaller than that of the rear-side door element; and e) a drum position determiner for stopping the drum in such a position that the drum opening substantially coincides with the tub opening.

With the drum door constructed as a double door having two door elements, if the front-side door element is very long, it obstructs the loading or unloading of the laundry because it overly protrudes when laid frontward. By the above-proposed washing machine (which is referred to as "the third washing machine" hereinafter), the throw-in opening is formed in the front-side part of the top of the housing, and the length of the front-side door element in the front-back direction is smaller than that of the rear-side door element. This construction reduces the projection of the front-side door element in the laid position. Therefore, the front-side door element does not obstruct the loading or unloading of the laundry. It is preferable to determine the length of the front-side door element so that the front-side door element in the laid position does not project at all, or projects by only a small amount, from the front of the housing. This design prevents the laundry from being caught by the door projecting from the front of the housing, or prevents the user from touching the door.

The present invention also proposes a drum type washing machine wherein a drum with a substantially cylindrical peripheral wall is mounted to rotate about a horizontal or inclined axis in a tub enclosed in a housing, which further includes:

a) a throw-in opening formed in the top of the housing, which can be closed by a lid;

b) a tub opening formed in the peripheral wall of the tub right under the throw-in opening, which can be closed by a tub door;

c) a drum opening formed in the peripheral wall of the drum;

d) a drum door for closing the drum opening, composed of a double door having two door elements, where the two door elements are engaged with each other at the overlapping parts when the drum door is closed;

e) a linking mechanism for linking the two door elements of the drum door to concurrently move the two door elements; and f) a drum position determiner for stopping the drum in such a position that the drum opening substantially coincides with the tub opening.

By the above washing machine (which is referred to as "the fourth washing machine" hereinafter), for example, the drum door has a projection formed in one door element and a hole formed in another door element to be engaged with the projection, and can be kept in the closed position by engaging the projection with the hole. For such an engagement to work, one door element must come over the other door element at the overlapping parts of the two door elements. With the above construction, when the drum door is closed, the linking mechanism moves one door element ahead of the other, keeping the two door elements relative to each other all the way. Thus, the two door elements are sure to engage each other at the overlapping parts, and the washing process can be started with the drum opening assuredly closed by the drum door.

DETAILED DESCRIPTION OF PREFERRED EMBODIMENTS

Figure 1:
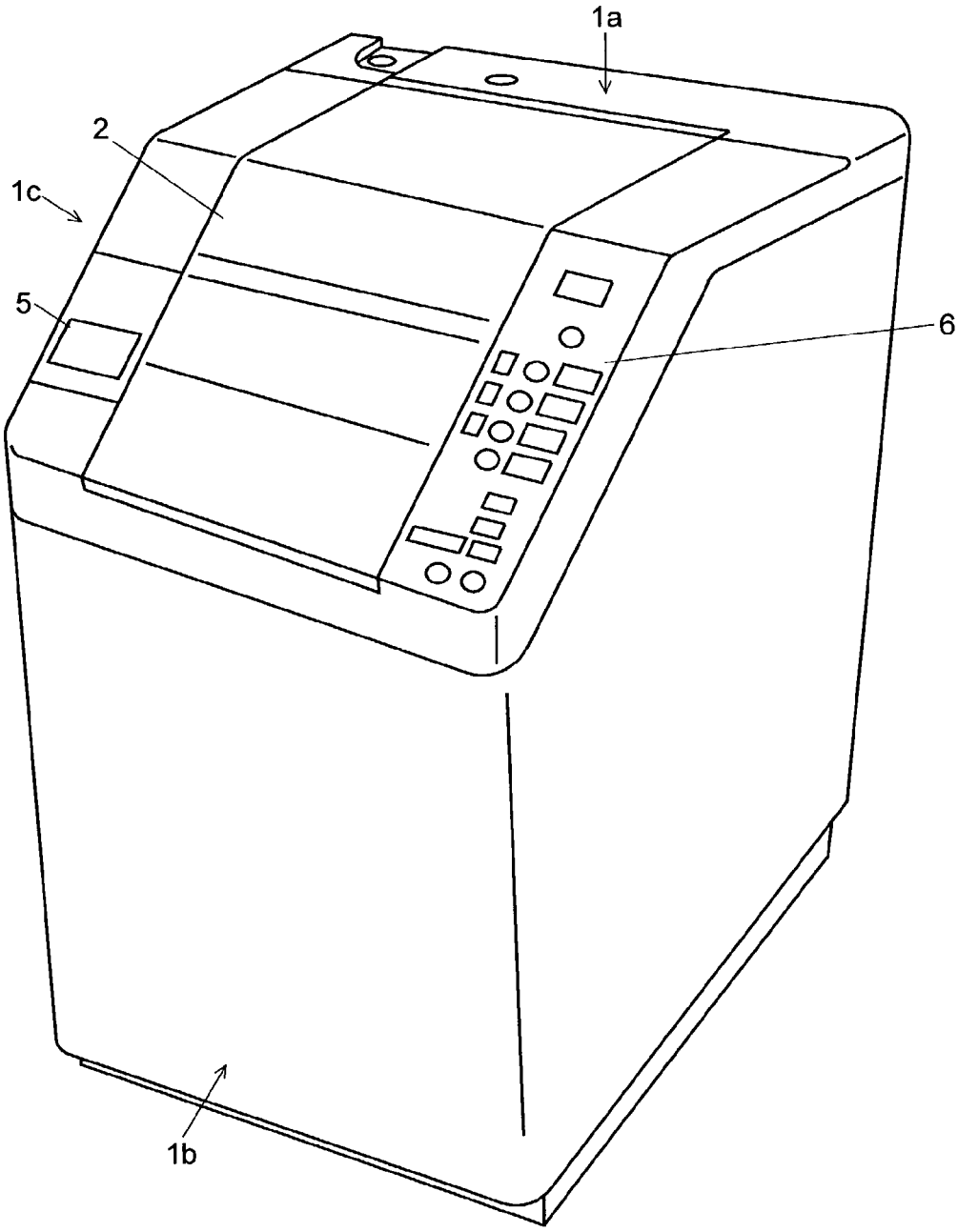
FIG. 1 is a perspective view of a drum type washing machine as a first embodiment of the present invention.

The first embodiment of the present invention is described referring to the drawings.

As shown in FIGS. 1 to 5, the washing machine of the first embodiment has a housing 1 having a part that declines with a slight roundness from the top 1*a* to the front 1*b* (the part is referred to as "the slope 1*c*" hereinafter). A large throw-in opening 3 (FIG. 5) is formed over the slope 1*c* and the horizontal part 1*d* across the bent part B (FIG. 4), and a lid 2 is provided to close the throw-in opening 3. When viewed from the side, the lid 2 as a whole looks like a dogleg with its front-side section declining downward.

Figure 4:
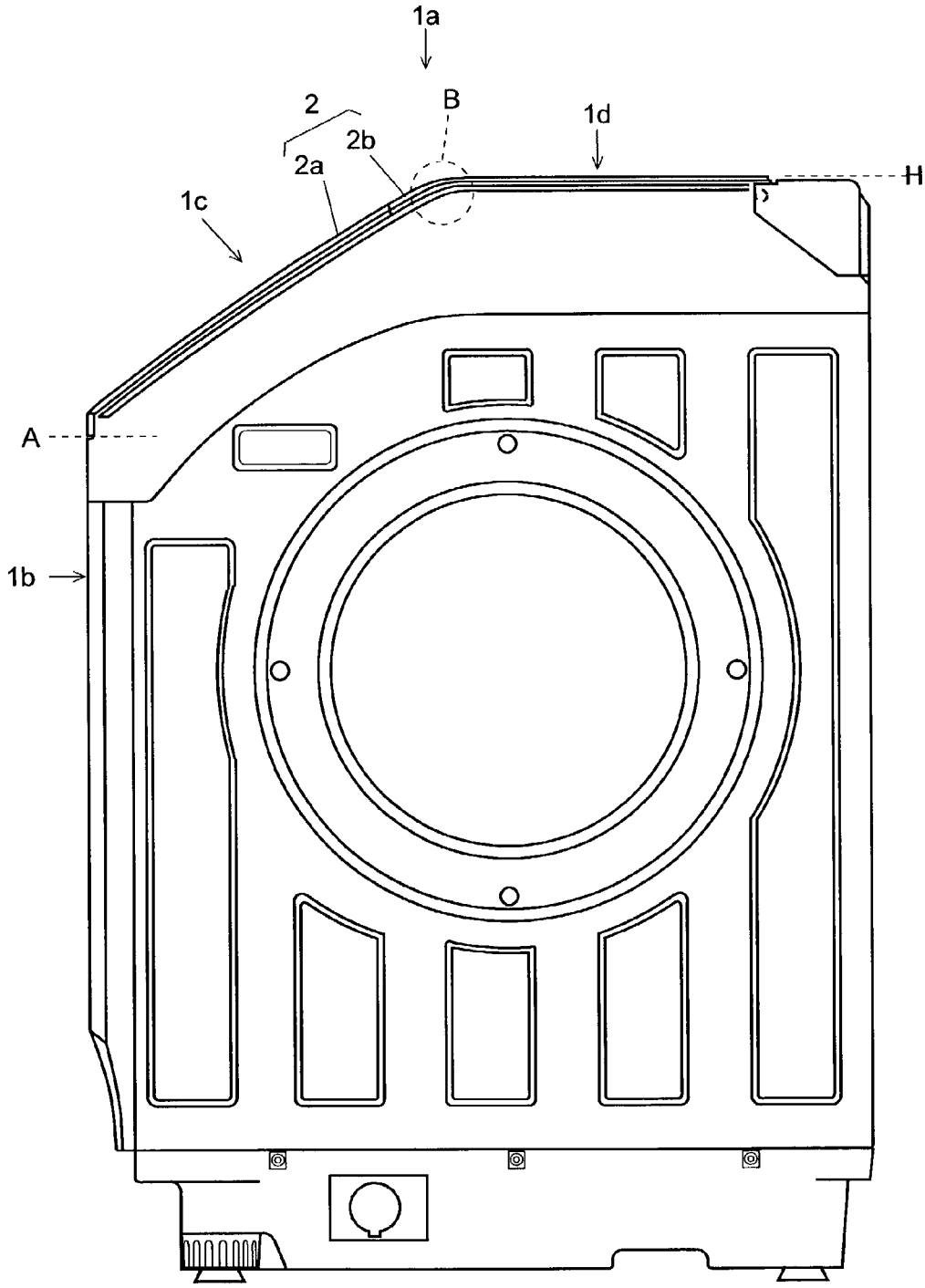
FIG. 4 is a right side view of the washing machine of the first embodiment.
Figure 5:
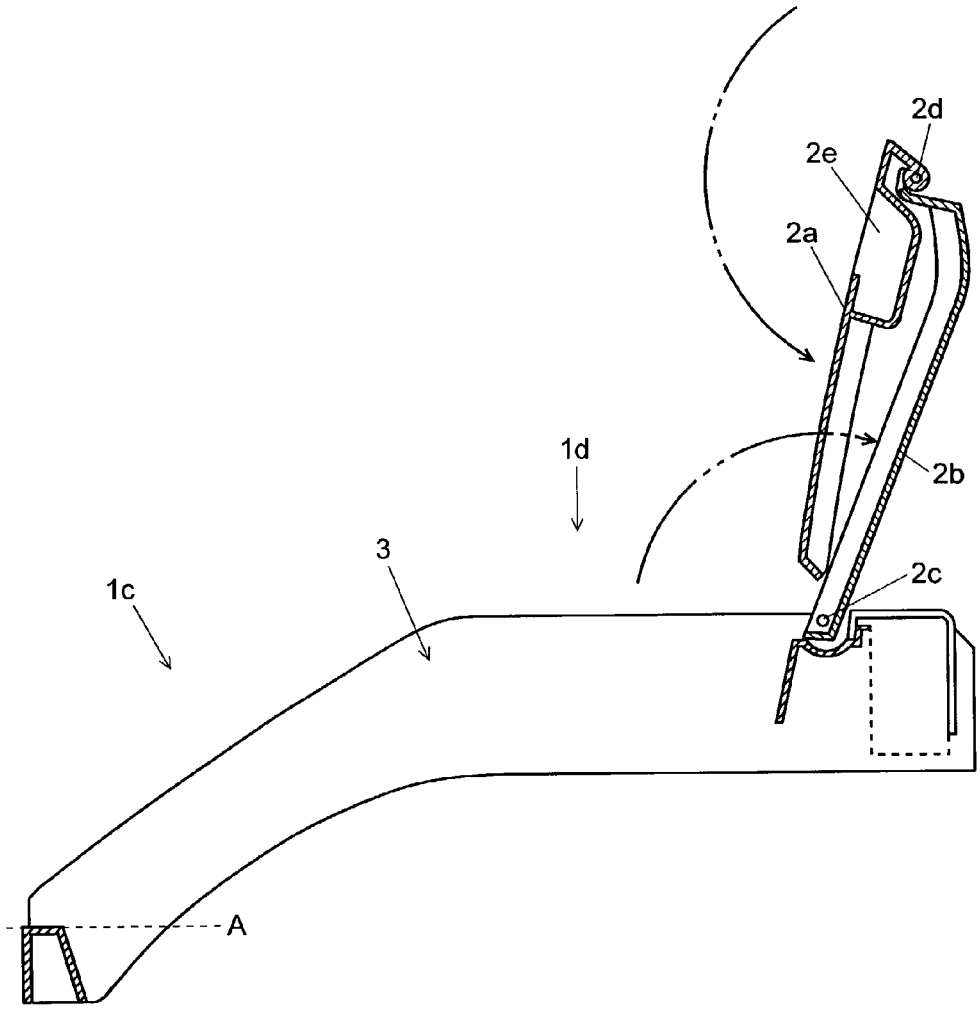
FIG. 5 is a vertical sectional view of a part of the washing machine of the first embodiment with the lid opened, viewed from the right side.

As shown in FIG. 5, the lid 2 is composed of a first lid member 2*a* and a second lid member 2*b*, both of which are hinged by a central shaft 2*d* horizontally extending in the lateral direction. The rear end of the second lid member 2*b* is connected to a rear shaft 2*c* horizontally extending in the lateral direction in the rear part of the top 1*a*. To open the lid 2 that is in the closed position as shown in FIG. 4, the user should lift the lid 2 and push it backward with the handle 2*e*, which is an indentation formed in the first lid member 2*a*. Then, the lid 2 stands in the folded position behind the throw-in opening 3, as shown in FIG. 5. The lid 2 extends over the horizontal part 1*d* and the slope 1*c* of the top 1*a* of the housing 1, including the bent part B, which corresponds to the boundary of the two parts. The central shaft 2*d*, at which the lid 2 bends, is located in the proximity to and in the front of the bent part B. Because of this design, even when the lid 2 is folded as shown in FIG. 5, the entire thickness of the lid 2 is small, and the lid 2 stands behind the throw-in opening 3 without obscuring the throw-in opening 3.

The height of the lower end of the lid 2, or the height of the front end A of the throw-in opening 3 must be determined appropriately. If the front end A is too high, the loading or unloading of the laundry will be hard for those users who are not tall. If it is too low, the lid 2 will be hard to open or close. In general, the height of the washing machine is confined to a certain range due to the limit of installation space or other factors. Taking this into account, the height of the front end A should be preferably 70–90% of the height of the washing machine.

Figure 2:
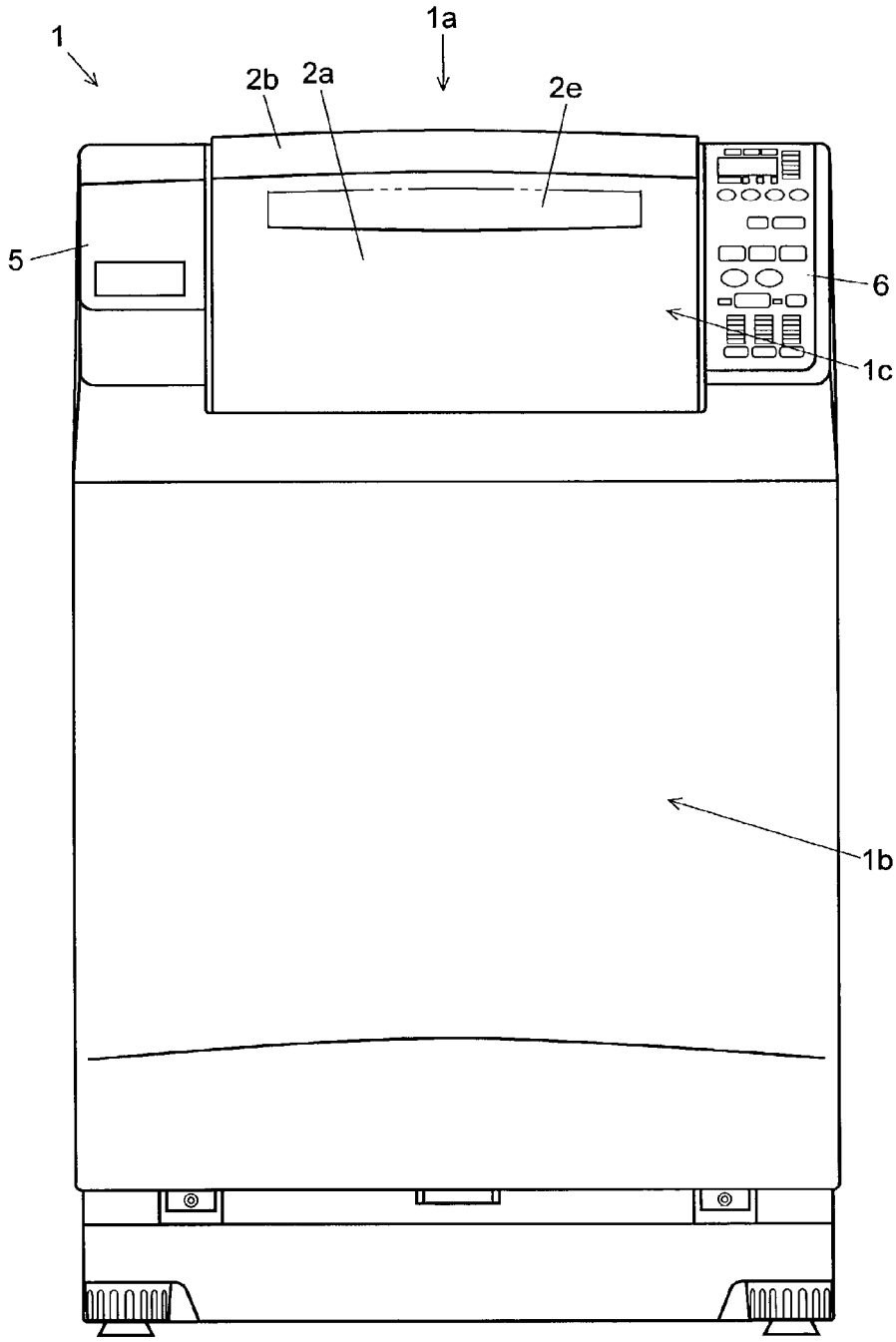
FIG. 2 is a front view of the washing machine of the first embodiment.
Figure 3:
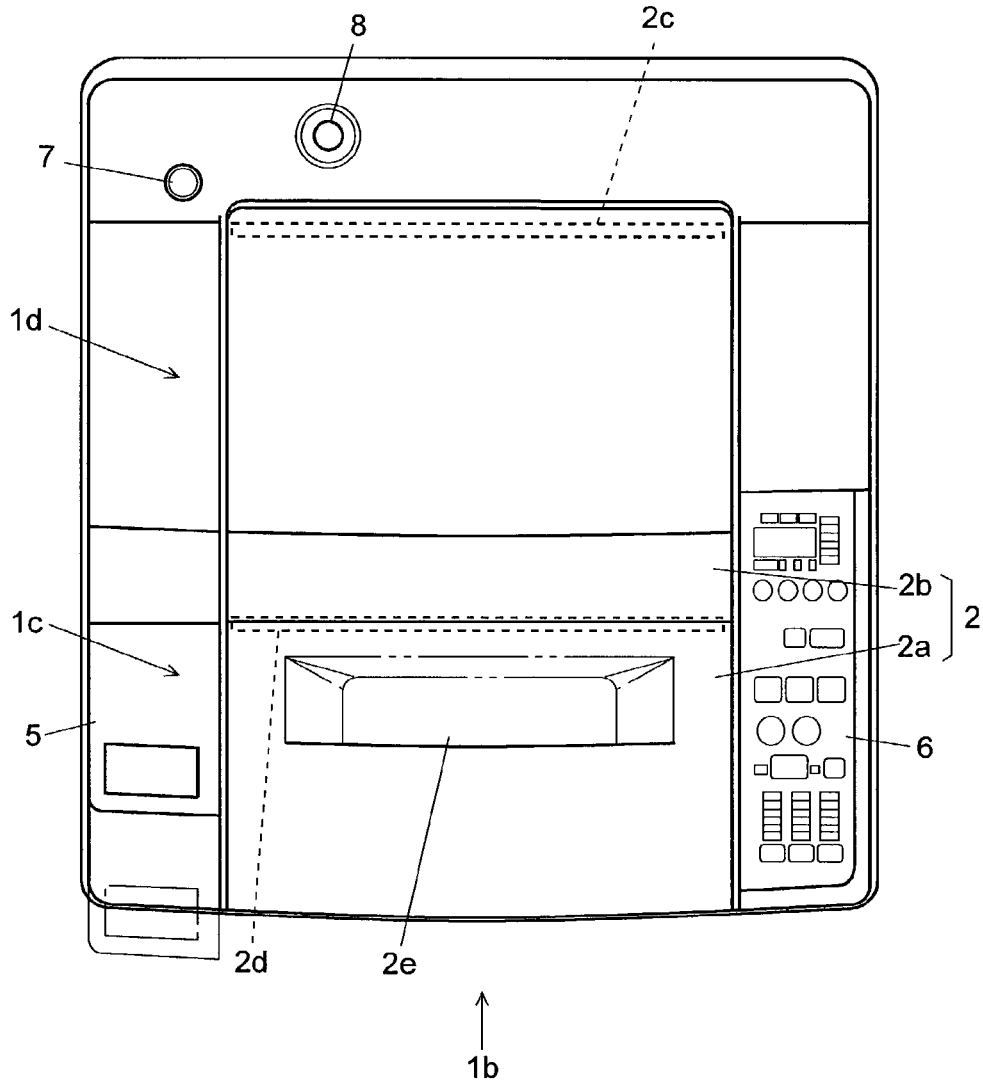
FIG. 3 is a plan view of the washing machine of the first embodiment.

As shown in FIGS. 1 to 3, a detergent container 5 that is drawable frontward is placed on the left side of the throw-in opening 3 on the slope 1*c*, and an control panel 6 extending in the front-back direction is placed on the right side. The control panel 6 is provided with various keys and display devices: the keys are used for setting the washing course, reservation time, etc., and the display devices are used for showing the state of setting, the progress of washing, the remaining time until the reserved time or until the end of operation, etc. Since the control panel 6 is directed obliquely upward, users can almost diretly look at the control panel 6 by standing in front of the washing machine and looking down. Therefore, the display is easy to view, and the keys are easy to operate.

The detergent container 5 and the control panel 6 are placed on the right and left sides of the lid 2, respectively. This placement provides an easy operation because the lid 2 obscures neither the detergent container 5 nor the control panel 6 when opened. The same effect can be obtained also by placing the detergent container 5 and the control panel 6 together on either side of the lid 2.

Figure 6A:
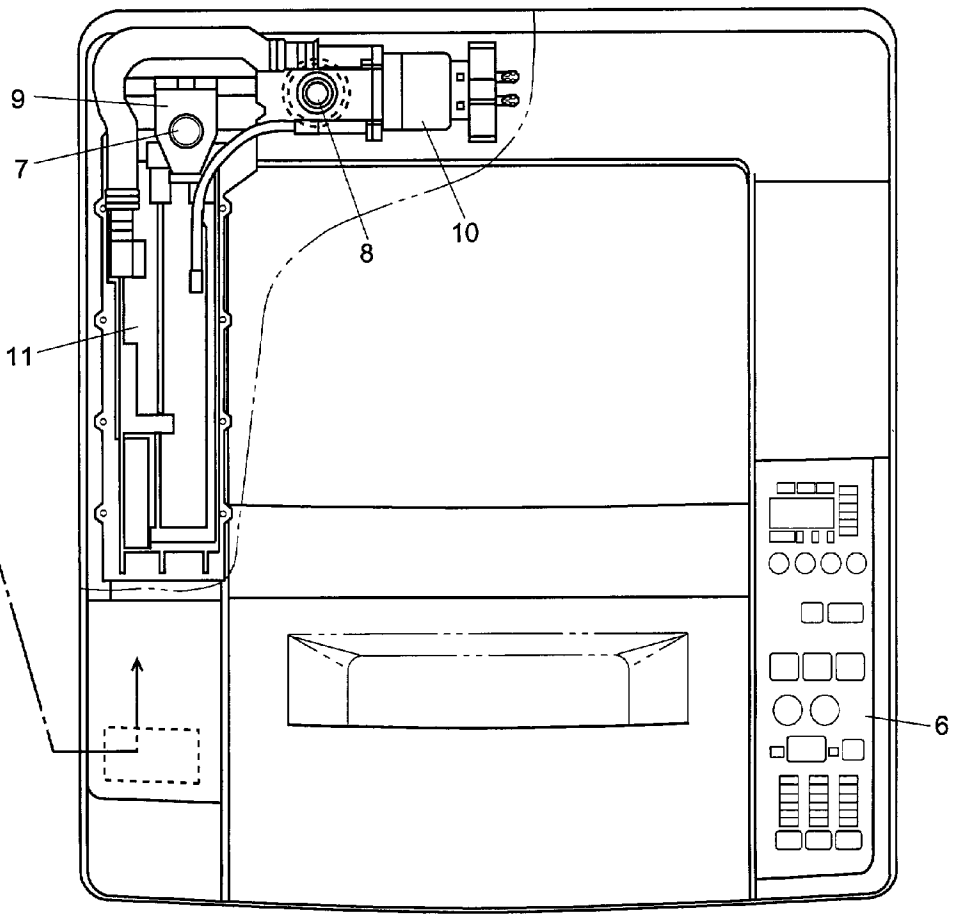
FIG. 6 is a top view of the washing machine of the first embodiment, showing (a) the structure of a water supply channel and (b) a detergent container.
Figure 6B:
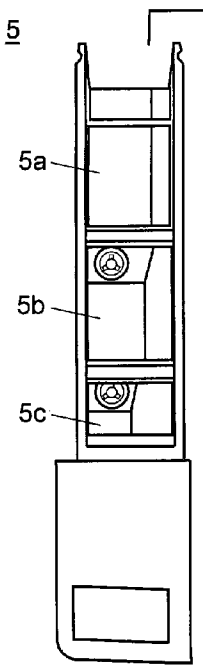

As shown in FIG. 6, the detergent container 5 is a box-shaped body with its top entirely open. The inside of the detergent container 5 is divided into three: a powder detergent chamber 5*a*, a liquid detergent chamber 5*b* and a softener chamber 5*c*. The detergent container 5 is placed on the slope 1*c*, as explained above. Therefore, even when the distance by which the detergent container 5 is drawn frontward is small, the detergent container 5 widely exposes its top, while being widely supported from below. Thus, users can put the detergent or fabric softener into the detergent container 5 without opening it a long way.

Referring to FIG. 6, on the top 1*a* and behind the lid 2 of the housing 1, there are a water inlet 7 and an auxiliary water inlet 8: the water inlet 7 is for the connection of an external water supply hose, and the auxiliary water inlet 8 is for the connection of a suction hose for taking water from a bathtub for reuse. A bath water supply pump 10 is placed beneath the auxiliary water inlet 8, and a quadruple water supply valve 9 is placed beneath the water inlet 7. The quadruple water supply valve 9 is for the following four purposes: to supply water through the detergent container 5, to supply either the detergent or the softener contained in the container 5, to supply water for a balancing operation to be described later, and to supply water for cooling humid air that contains steam emitted from the laundry during the drying operation.

The water supply valve 9 or the bath water supply pump 10 supplies water to a casing 11 for holding the detergent container 5 inside. When the detergent container 5 is set in the casing 11, the water flows into one or more of the powder detergent chamber 5*a*, the liquid detergent chamber 5*b* and the softener chamber 5*c*.

Figure 7:
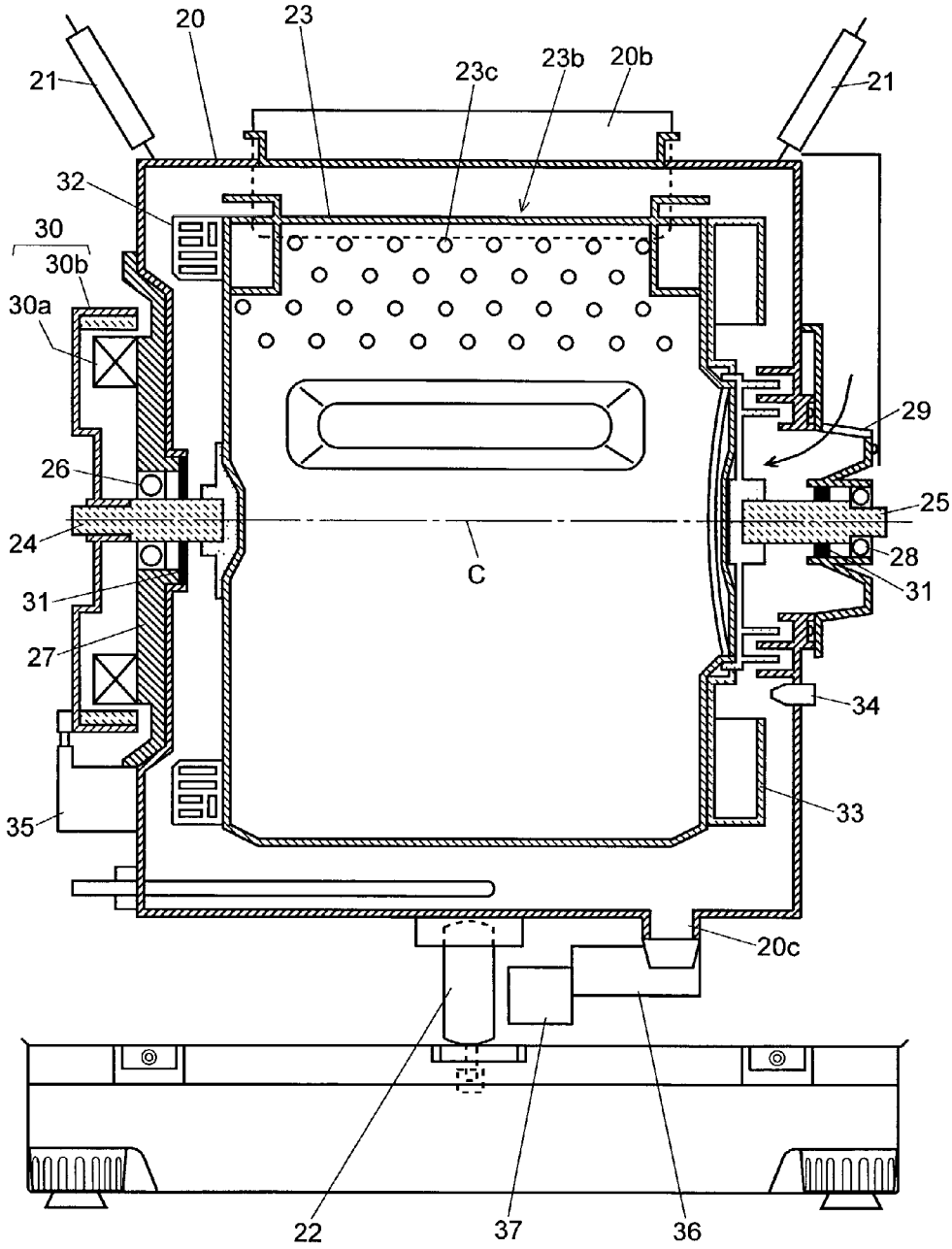
FIG. 7 is a vertical sectional view showing the internal structure of a part of the washing machine of the first embodiment, viewed from the front.
Figure 8:
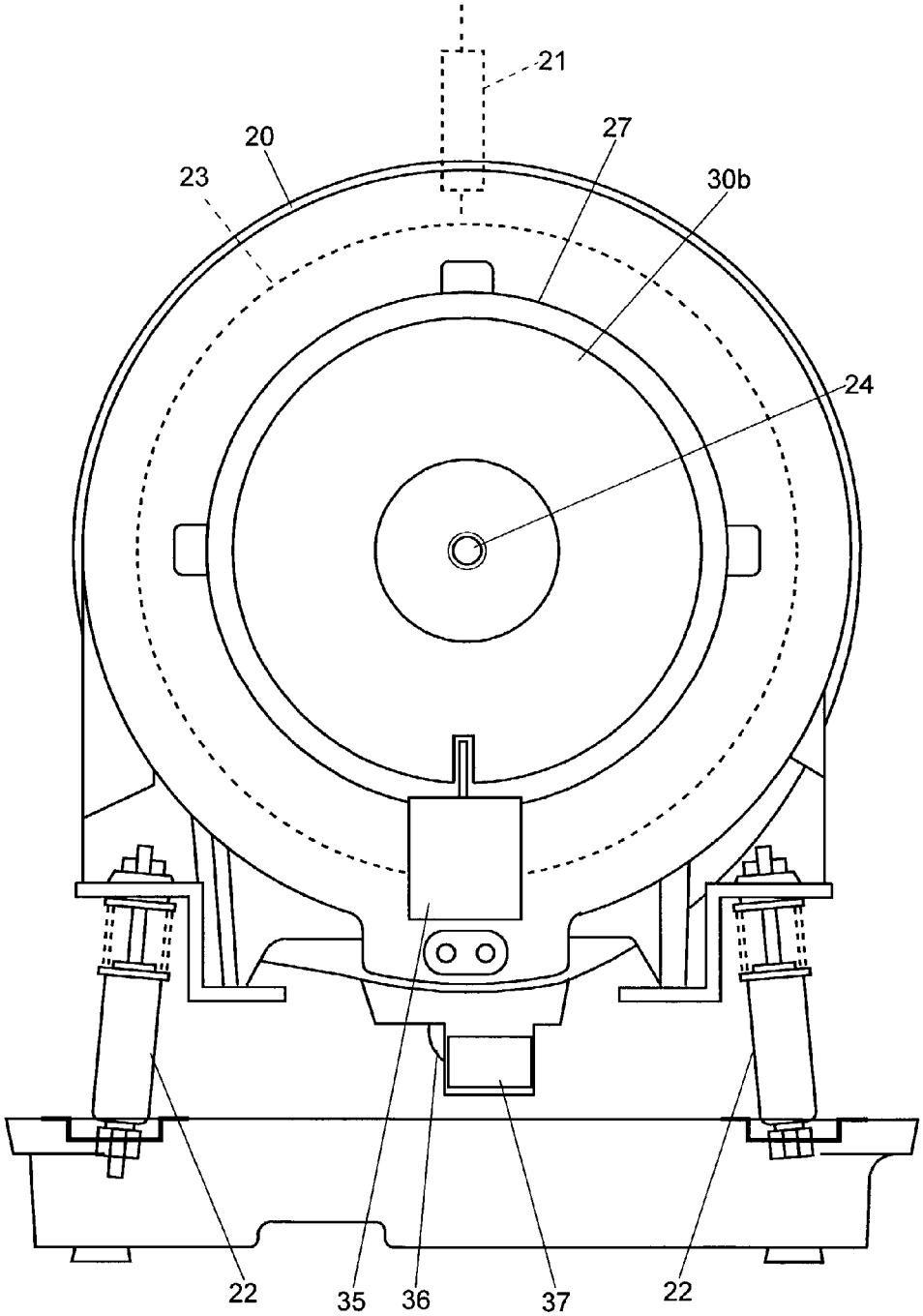
FIG. 8 is a vertical sectional view showing a part of the washing machine of the first embodiment with the housing removed, viewed from the left side.
Figure 9:
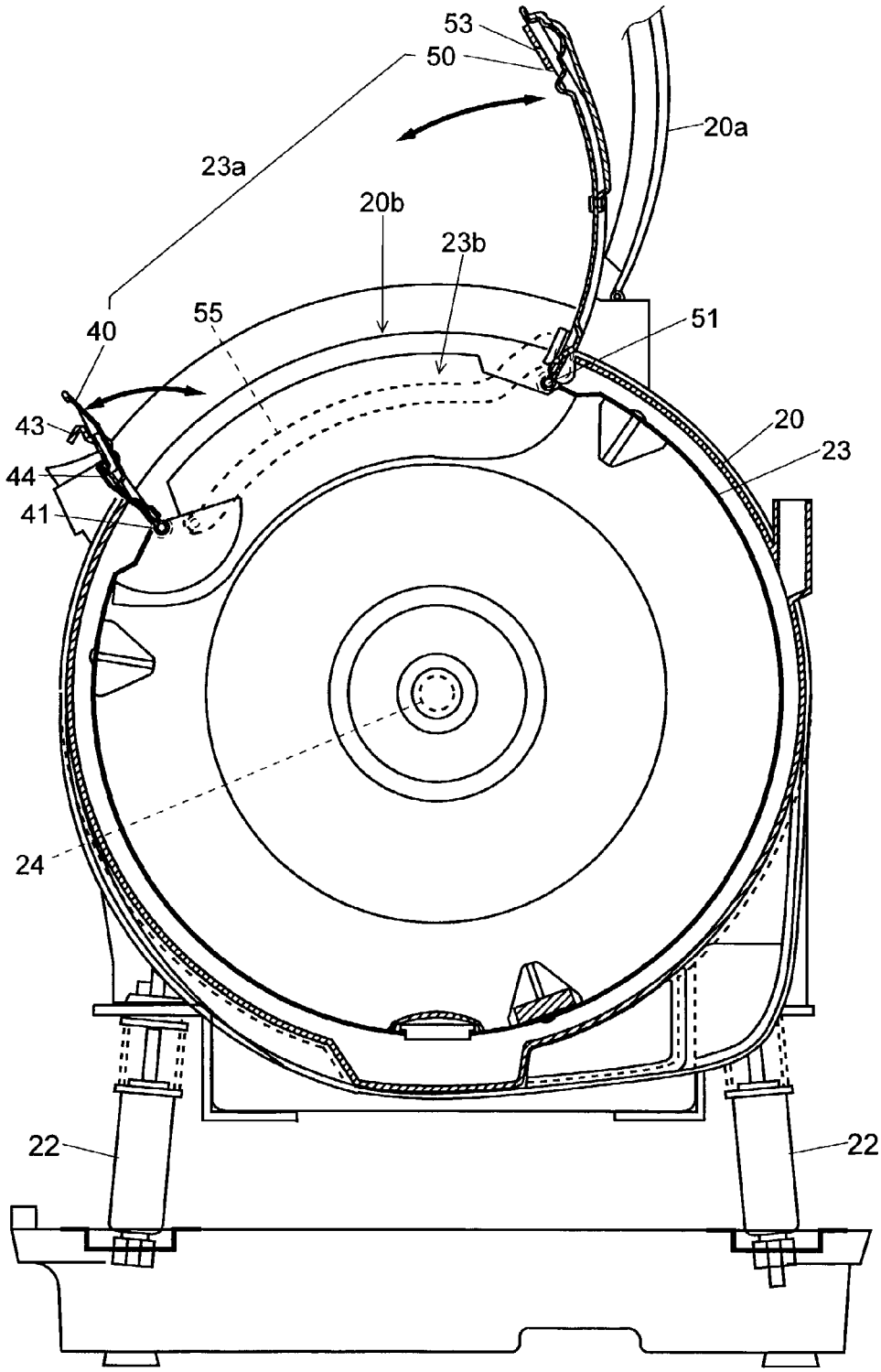
FIG. 9 is a vertical sectional view showing a part of the inside of the washing machine of the first embodiment, viewed from the right side.

Referring to FIGS. 7 to 9, the internal structure of the washing machine of this embodiment is described. It should be noted that, in the washing machine of this embodiment, the drum with the substantially cylindrical peripheral wall is mounted to rotate about a horizontal axis extending in the lateral direction. With conventional drum type washing machines, the drum is generally mounted to rotate about an axis extending either horizontally in the front-back direction or an axis up-inclined from back to front.

In the housing 1, a tub 20, which is a substantially cylindrical hollow body with both ends substantially closed, is supported by a pair of springs 21 and a damper 22. The springs 21 pull up the tub 20 from the right and left sides of the housing 1, and the damper 22, extending in the front-back direction, supports the tub 20 from below. Thus, the tub 20 is allowed to oscillate to a certain extent. The tub 20 encloses a drum 23 to contain the laundry. The drum is a substantially cylindrical hollow body with both ends substantially closed, and is rotatable about a horizontal axis C extending in the lateral direction. The drum 23 has a number of holes 23*c* for letting the water pass. The horizontal axis C is defined by a first bearing 26, which holds the main shaft 24 fixed to the left side of the drum 23, and a second bearing 28, which holds the auxiliary shaft 25 fixed to the right side of the drum 23. The first bearing 26 is held by a bearing case 27 fixed to the left side of the tub 20, and the second bearing 28 is held by another bearing case 29 fixed to the right side of the tub 20. Oil seals 31 are inserted between the main shaft 24 and the bearing case 27 and also between the auxiliary shaft 25 and the bearing case 29 so that no water reaches the first and second bearings 26 and 28 when water is stored in the tub 20. A motor 30, which is a DC brush-less motor of outer rotor type, has a stator 30*a* and a rotor 30*b*. The stator 30*a* is fixed to the bearing case 27, and the rotor 30*b* is fixed to the end of the main shaft 24 penetrating the tub 20 to the left. By placing the rotor 30*b* having permanent magnets around the stator 30*a* having windings, the motor 30 is thinly constructed in the direction of the horizontal axis C. The motor 30 thus constructed directly drives the drum 23 via the main shaft 24. When a driving voltage is supplied from a controller (not shown) to the stator 30*a*, whereby the rotor 30*b* is rotated, and the drum 23 is driven by the main shaft 24 to rotate at the same speed as that of the rotor 30*b*. At the bottom of the tub 20 is provided a drain 20*c*, which leads through a drainage valve 36 and a drainage hose (nor shown) to an external drainage ditch. The drainage valve 36 is opened or closed by a torque motor 37. In addition, though not described in detail here, the washing machine has an air circulation passage on the right side of the tub 20. During the drying operation, the air circulation passage is used for supplying hot air into the drum 23 and for re-heating the air from which the steam emitted from the laundry has been removed by condensation and liquefaction.

Different from conventional drum type washing machines in which the drum is supported by a cantilever structure, the washing machine of this embodiment supports the drum 23 at both ends. Therefore, the vibration almost never occurs during a centrifugal extraction process even if the laundry is unevenly distributed. However, in order to prevent the vibration assuredly, the washing machine of this embodiment employs two types of balancing structures. One is a fluid balancer 32 attached to the circumference of the left side of the drum 23, the same side as the motor 30. The fluid balancer 32 is a hollow circular body containing a liquid, in which the motion of the liquid is moderately restrained. When attached to the drum 23, the balancer 32 works to suppress the vibration of the drum 23, like a balancing ring used in conventional whirl type washing machines. The other is plural water tanks 33 radially attached to the circumference of the right side of the drum 23, opposite to the fluid balancer 32 across the drum 23. Each water tank 33 is a pocket-shaped body opened to the inside. The water tanks 33 are a part of a balance-adjusting mechanism of variable weight type, which further includes a nozzle 34 for injecting water into the water tanks 33, a water supply channel (not shown) for supplying the nozzle 34 with water from the water supply valve 9, etc. The basics of the balance-adjusting mechanism are as follows. During the rotation of the drum 23, water is ejected from the nozzle 34 into one of the water tanks 33 when the objective water tank 33 is near the nozzle 34. Then, the water is held in the water tank 33 by centrifugal force, and becomes like a weight adding an eccentric load to the drum 23. Therefore, by injecting adequate amount of water into the water tank 33 that is opposite to the eccentric load due to the uneven distribution of the laundry across the central axis, the entire amount of eccentricity of the drum 23 can be reduced. The balance adjusting methods and mechanisms proposed in the Japanese Patent Application No. 2001-161855 by the applicant can be used for performing the above-described operation.

With the washing machine of this embodiment, the throw-in opening 3 is formed over the horizontal part 1*d* and the slope 1*c* of the lid 2, as described above, and a tub opening 20*b* for the loading or unloading of the laundry is formed from the upper part to the front part of the peripheral wall of the tub 20 at such a position that it coincides with the throw-in opening 3. The tub opening 20*b* can be closed by a tub door 20*a*. Also, a drum opening 23*b* for the loading or unloading of the laundry is formed in the peripheral wall of the drum 23, with a drum door 23*a* for closing the drum opening 23*b*. The laundry is loaded into or unloaded out of the drum 23 through the tub opening 20*b* and the drum opening 23*b*. The drum 23, however, may rotate in the tub 20. Therefore, a drum-position-fixing unit 35 is placed under the stator 30*a* in order to hold the drum 23 in such a position that the drum opening 23*b* coincides with the tub opening 20*b* in radial direction. When the drum 23 is stopped, a locking pin projecting from the unit 35 engages with a locking hole formed on the rotor 30*b*, whereby the position of the drum 23 is determined. Thus, the locking pin and the locking hole comprise an exemplary drum position determiner.

Referring to FIGS. 10 to 13, the structures for opening and closing the tub door 20*a* and the drum door 23*b* for the loading or unloading of the laundry are described. These structures feature the washing machine of this embodiment.

Figure 10:
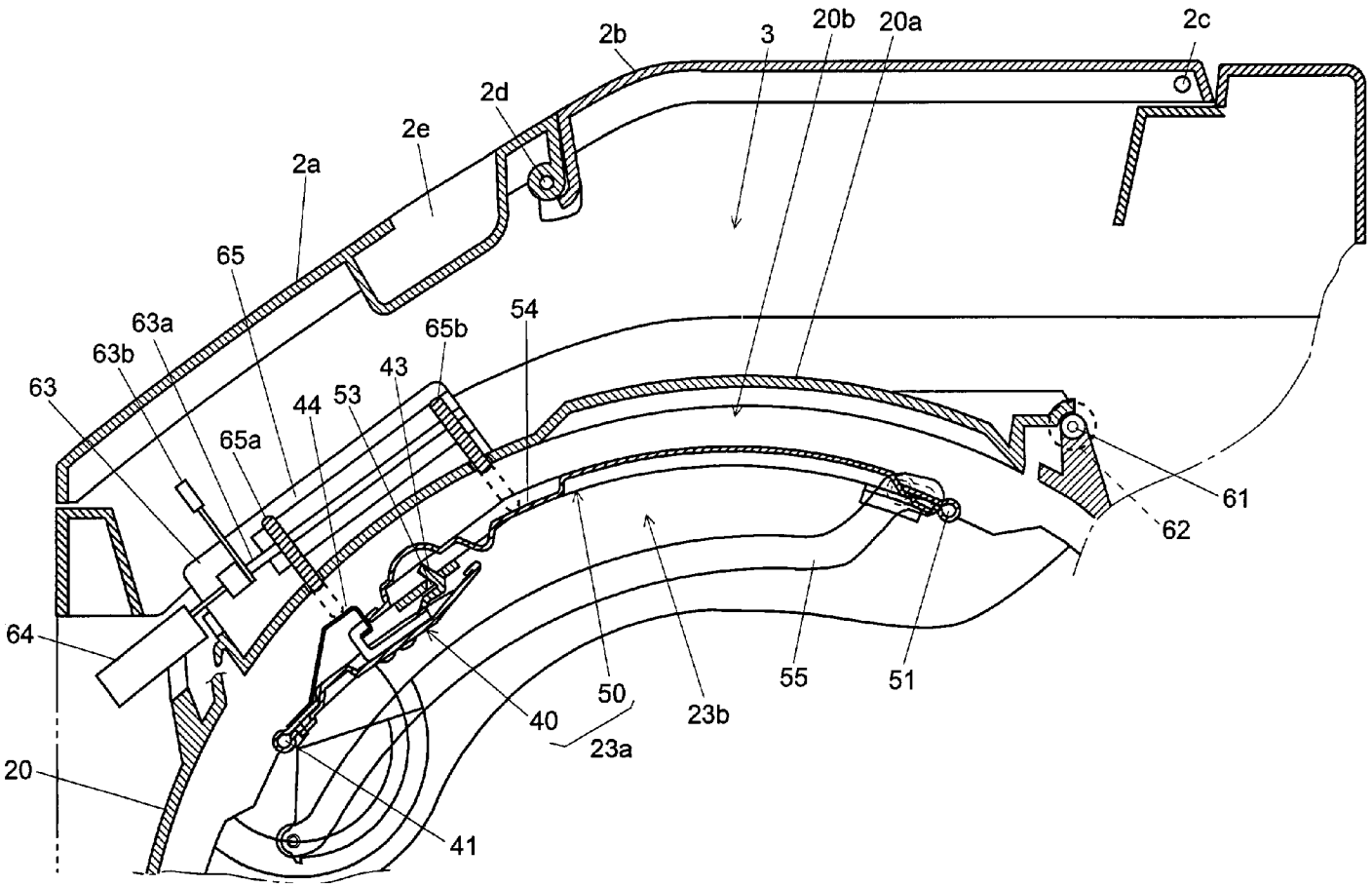
FIG. 10 is a vertical sectional view of a part around the throw-in opening of the washing machine of the first embodiment, viewed from the right side.

As shown in FIG. 10, the drum 23 is enclosed in the tub 20 placed under the throw-in opening 3 closed by the lid 2. The tub opening 20*b* and the drum opening 23*b* are formed so that their orientations are inclined frontward from the upright direction. The tub opening 20*b* and the drum opening 23*b* are closed by the tub door 20*a* and the drum door 23*a*, respectively. Therefore, to load the laundry into the drum 23, it is necessary to open the two doors, i.e. the tub door 23*a* and the drum door 20*a*. If both doors should be opened independently, users need to take the following troublesome three steps to load the laundry: to open the lid 2, to open the tub door 20*a* and to open the drum door 23*a*. Therefore, the washing machine of this embodiment is constructed so that the tub door 20*a* and the drum door 23*a* are opened by a single and simple operation.

Figure 11B:
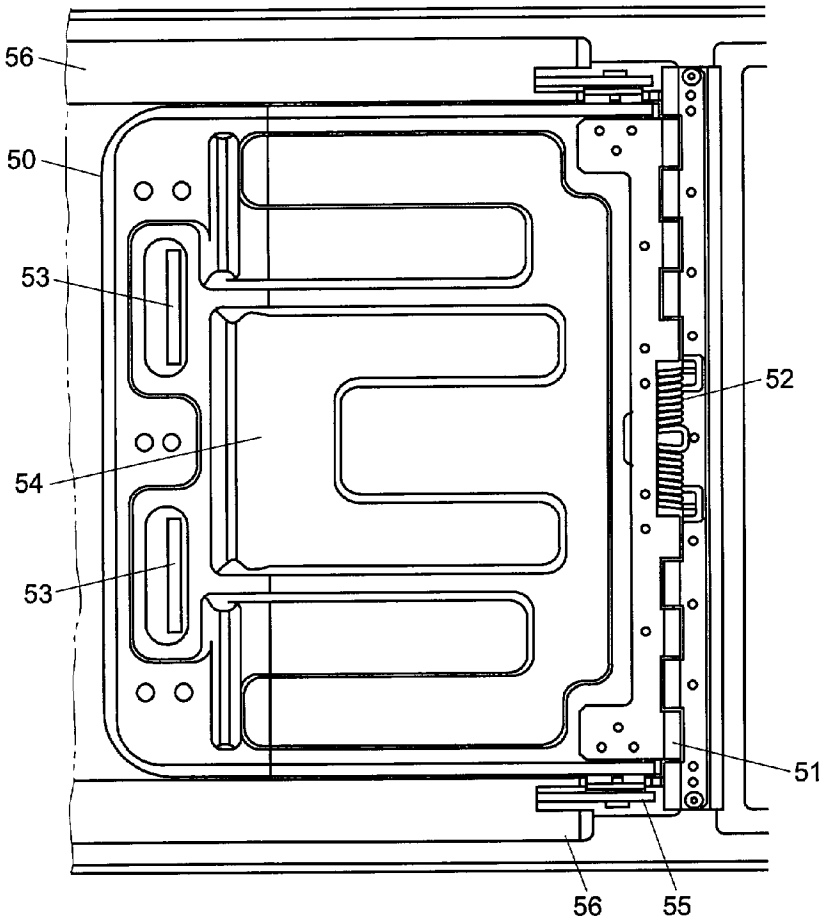
FIGS. 11A–B are plan views of the structure for opening and closing the drum door of the washing machine of the first embodiment.
Figure 11A:
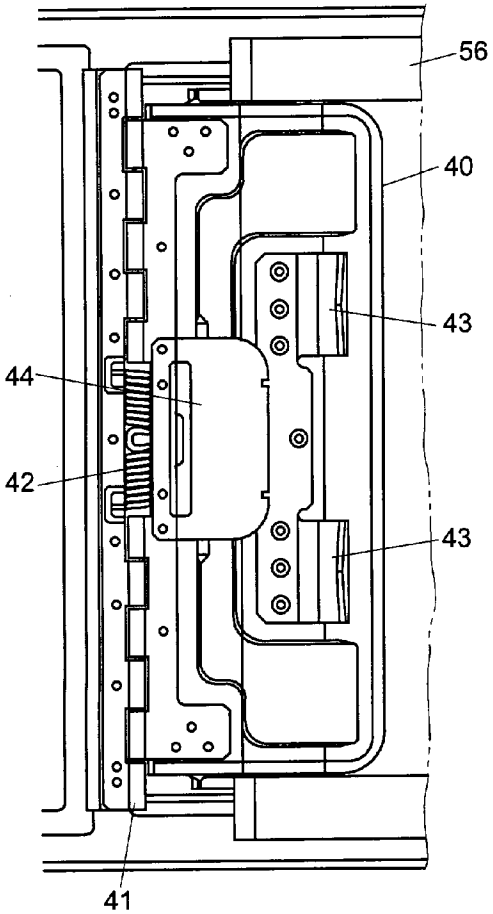
Figure 12:
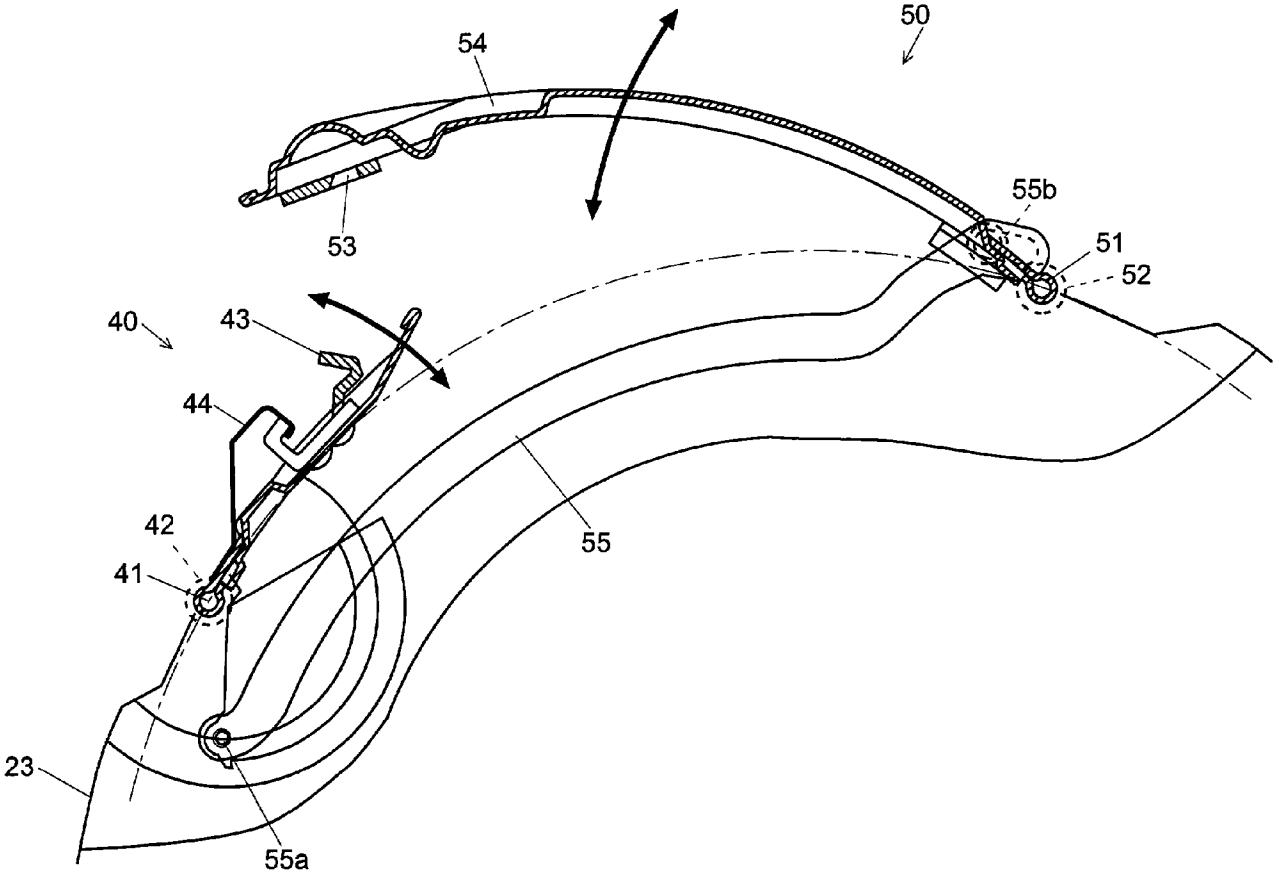
FIG. 12 is a vertical sectional view of the structure for opening and closing the drum door of the washing machine of the first embodiment, viewed from the right side.

As shown in FIGS. 11 and 12, the drum door 23*a* is composed of a front-side door 40 and a rear-side door 50. The front-side door 40 is rotatable about a front shaft 41 extending along the lateral direction, and the rear-side door 50 is rotatable about a rear shaft 51. When the drum door 23*a* is closed, the front-side door 40 and the rear-side door 50 are laid overlapping each other at their end edges (FIG. 10). When the drum door 23*a* is opened, the two doors open like a double door. With this double door structure, when the drum door 23*a* is opened, the front-side door 40 is laid forward and closes the space between the tub 20 and the drum 23. Therefore, while being loaded into the drum 23, the laundry is prevented from falling into or getting caught in the space between the tub 20 and the drum 23. The front-side door 40, however, would obstruct the loading of the laundry if it projected too much when opened. Therefore, the front-side door 40 is designed to be shorter in the front-back direction than the rear-side door 50 so that it protrudes only a little.

The front-side door 40 is forced into the opening direction by a forcing mechanism such as a spring 42 wound on the front shaft 41. A claw 43 directed upward is provided at the overlapping part of the front-side door 40. The claw 43 is connected to a supporting plate 44 that functions like a spring. When a force is exerted from the outside of the drum 23 on the supporting plate 44, the claw 43 goes down into the inside of the drum 23, and when the force is removed, the claw 43 returns to the original position. The rear-side door 50, on the other hand, is forced into the opening direction by a forcing mechanism such as a spring 52 wound on the rear shaft 51. An engagement hole 53 to be engaged with the claw 43 is formed at the overlapping part. Thus, the claw 43 and the engagement hole 53 comprise an exemplary drum-door-latching mechanism or engaging mechanism. The front-side door 40 and the rear-side door 50 are connected by a linking mechanism, such as a linking element 55, over which a cover 56 is placed. The linking element 55 is connected to the front-side door 40 via a linking shaft 55*a*, and to the rear-side door 50 via a linking shaft 55*b*. The function of the linking element 55 is to link the front-side door 40 and the rear-side door 50 so that they maintain a preset relationship while being opened or closed. In detail, when the front-side door 40 and the rear-side door 50 are closed from the opened position, the linking element 55 makes the front-side door 40 close before the rear-side door 50. In this operation, when the two doors are closed, the end edge of the rear-side door 50 always comes over the end edge of the front-side door 40, and never vice versa.

The tub door 20*a* is composed of a single door rotatable about a substantially horizontal axis 61 extending in the lateral direction. The tub door 20*a* is forced into the opening direction by a forcing mechanism such as a spring 62 wound on a shaft 61. A door side latching mechanism 63 and a tub side latching mechanism 64 are provided to the tub door 20*a* and the front side of the tub 20, respectively. The two mechanisms engage with each other to keep the tub door 20*a* in the closed position. The door side latching mechanism 63 has an operation mechanism or lever 63*b* rotatable about a shaft 63*a* in the lateral direction between a latching position and an unlatching position. When the operation lever 63*b* is in the latching position, the latching mechanisms 63 and 64 engage each other, and the tub door 20*b* is latched in the closed position. Thus, the latching mechanisms 63 and 64 comprise an exemplary tab-door-latching mechanism. When the operation lever 63*b* is in the unlatching position, the two mechanisms 63 and 64 are released from the engagement, and the tub door 20*a* is allowed to open.

The door side latching mechanism 63 is integrally constructed with a drum door open/close or unlatching mechanism 65 provided behind it. The drum door open/close mechanism 65 includes a first rod 65*a* and a second rod 65*b*, both directed to the inside of the drum 23 and movable between projected and withdrawn positions. The first rod 65*a* is located so that it contacts the supporting plate 44 when it fully projects with the drum door 23*a* closed. The second rod 65*b* is located so that it contacts a flat part 54 of the rear-side door 50 when it fully projects with the drum door 23*a* closed. The first and second rods 65*a* and 65*b* move back and forth together with the rotation of the operation lever 63*b* in the lateral direction. In detail, when the operation lever 63*b* is rotated from the latching position to the unlatching position, the first rod 65*a* temporarily projects, and then returns back to the withdrawn position when the operation lever 63*b* reaches the end of the rotation. When the operation lever 63*b* is inversely rotated from the unlatching position to the latching position, the second rod 65*b* is temporarily projected, and then returns to the hidden position when the operation lever 63*b* reaches the end of the rotation.

Figure 13A:
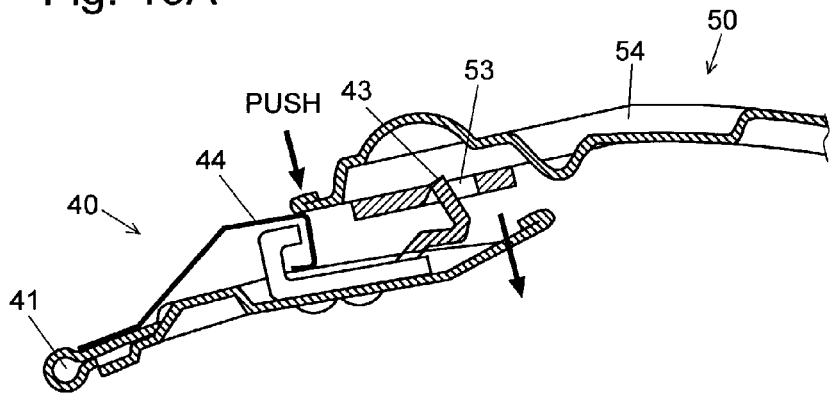
FIGS. 13A and 13B are vertical sectional views of a part of the washing machine of the first embodiment, viewed from the right side, showing the open/close motion of the drum door.
Figure 13B:
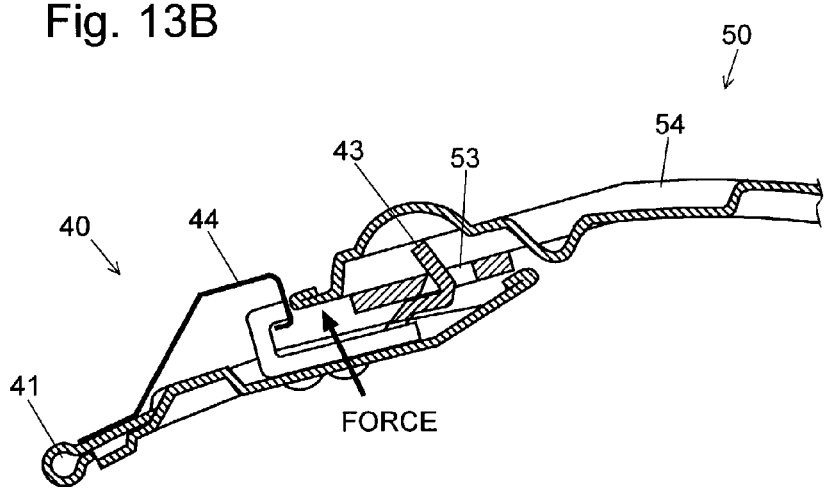

When the laundry is loaded into or unloaded out of the drum 23, the above mechanisms operate as follows. It is assumed that at first the throw-in opening 3 is closed by the lid 2, the tub opening 20*b* is closed by the tub door 20*a*, and the drum opening 23*b* is closed by the drum door 23*a*, as shown in FIG. 10. First, the user inserts a finger or fingers into the handle 2*e*, lifts the lid 2 and pushes it backward. Then, the lid 2 stands in the folded position behind the throw-in opening 3, as shown in FIG. 5. Next, the user rotates the operation lever 63*b* from the latching position to the unlatching position. This operation releases the latching mechanisms 63 and 64 from the engagement, and now the tub door 20*a* is allowed to rotate about the shaft 61. In the course of the rotation of the operation lever 63*b*, the first rod 65*a* of the drum door operation mechanism 65 temporarily projects. As explained above, the first rod 65*a* is located to contact the supporting plate 44 of the front-side door 40 when it fully projects. In the position as shown in FIG. 13B, the supporting plate 44 is pressed by the first rod 65*a*, whereby the front-side door 40 is rotated downward about the shaft 41. Then, the claw 43 comes off the engagement hole 53, removing the force that pulls the rear-side door 50 downward, and the rear-side door 50 is rotated in the opening direction by the force of the spring 52. At this moment, if the tub door 20*a* has already been unlatched, the rear-side door 50 lifts the tub door 20*a* open. The spring 52 is designed to yield such an appropriate magnitude of force that supports the rear-side door 50 in a little lifted position with the tub door 20*a* supported by the rear-side door 50. This design not only allows the user to easily recognize that the tub door 20*a* is now allowed to open, but also makes the tub door 20*a* easy to open.

When the first rod 65*a* returns to its original position, the force to push the front-side door 40 is removed. Then, the front-side door 40, forced by the spring 42, attempts to rotate in the opening direction. There, if the rear-side door 50 is not widely opened, the front-side door 40 stands by under the rear-side door 50. In this state, the claw 43 cannot enter the engagement hole 53, so that front-side door 40 and the rear-side door 50 do not engages with each other. When the user opens the tub door 20*a* backward, the rear-side door 50, forced by the spring 52, rotates backward after the tub door 20*a* (FIG. 12). The motion of the rear-side door 50 is transmitted via the linking element 55 to the front-side door 40, whereby the front-side door 40 is rotated forward with a little delay. Thus, the drum door 23*a* is opened like a double door together with the opening motion of the tub door 20*a*. Thus, the drum door open/close mechanism and the springs 42, 52 comprise an exemplary (drum) door-linking mechanism 65, linking the opening of the drum door to the opening of the tub door. Through the openings widely opened, the user can load the laundry into the drum 23, or unload the laundry out of the drum 23.

After, for example, loading the laundry into the drum 23, the user performs a closing operation by rotating the tub door 20*a* forward that is then standing with a slight inclination backward. Then, pushed by the tub door 20*a*, the rear-side door 50 also rotates. There, because of the function of the linking element 55, the front-side door 40 also rotates ahead of the rear-side door 50 and reaches the closing position of the drum opening 23*b*. Pushing the tub door 20*a* down to a preset position, the user rotates the operation lever 63*b* from the unlatching position to the latching position to lock the tub door 20*a*. In the course of the rotation of the operation lever 63*b*, the second rod 65*b* of the drum door operation mechanism 65 temporarily projects. As explained above, the second rod 65*b* is positioned to contact the flat part 54 of the rear door 40 when it fully projects. In the position as shown in FIG. 13A, the flat part 54 is pushed by the second rod 65*b*, whereby the rear-side door 50 is rotated downward about the shaft 51, pushing the front-side door 40 down. Then, the claw 43 enters the engagement hole 53, and the front-end edge of the rear-side door 50 is pressed against the supporting plate 44 of the front-side door 40 to make the two parts engage each other. Thus, the drum door 23*a* is closed together with the closing and latching operation of the tub door 20*a*.

As described above, the tub door 20*a* and the drum door 23*a* can be opened or closed by simple operations.

The steps of the washing operation by the washing machine of this embodiment is outlined below. In advance, the user should put a detergent or softener in the detergent container 5 at an appropriate timing before or after the loading of the laundry. After loading the laundry into the drum 23 as described above, the user performs a predetermined operation on the control panel 6 to instruct the washing machine to start the washing operation. After the start of the washing operation, the water supplied from a bath or an external water supply tap is introduced through the detergent container 5 into the tub 20. At this time, the drainage valve 36 is closed, so that the water in which the detergent contained the detergent container 5 is dissolved is stored in the tub 20. The water thus stored in the tub 20 enters the drum 23 through the holes 23*c* or other passages, and the laundry in the drum 23 is immersed in the water. After the start of the washing operation, a driving current is supplied to the stator 30*a* of the motor 30, and the drum 23 starts rotating in a preset direction at a preset speed. The drum 23 thus rotating makes the laundry tumble inside, whereby the stain or the like is removed from the laundry. After the washing operation is completed, the water in the tub 20 is renewed, and a rinsing operation is performed in a similar manner. After the washing or rinsing operation, an intermediate or final extracting operation is performed. This time, the speed of the motor 30 is raised to, for example, about 1000 r.p.m. There, the drum 23 also rotates at that speed, whereby water is centrifugally extracted from the laundry. During the extracting operation, the drum 23, the tub 20 and the housing 1 are prevented from excessive vibration because of the function of the fluid balancer 32. The balancing mechanism also works there, if necessary. After the extracting operation, hot air is introduced into the drum 23 to dry the laundry. After the drying operation, the drum 23 is stopped, and the user unloads the laundry out of the drum 23.

The second embodiment of the present invention is described referring to the drawings. The washing machine of the second embodiment is distinguished from that of the first embodiment by different mechanisms for opening and closing the tub door and the drum door to be opened when the laundry is loaded into or unloaded out of the drum 23. In this respect, a detailed description is presented below referring to FIGS. 14 to 20. It should be noted that the tub door 110, tub opening 100, drum door 310 and drum opening 200 of the second embodiment correspond to the tub door 20*a*, tub opening 20*b*, drum door 23*a* and drum opening 23*b* of the first embodiment.

The washing machine of this embodiment has a lid 2 for closing a throw-in opening 3, a tub door 110 for closing an tub opening 100, and a drum door 310 for closing a drum opening 300, and the user needs to open these doors to load or unload the laundry into or out of a drum 23. To improve the user-friendliness, the tub door 110 and the drum door 310 of this embodiment are constructed to open together by a single operation.

Figure 14:
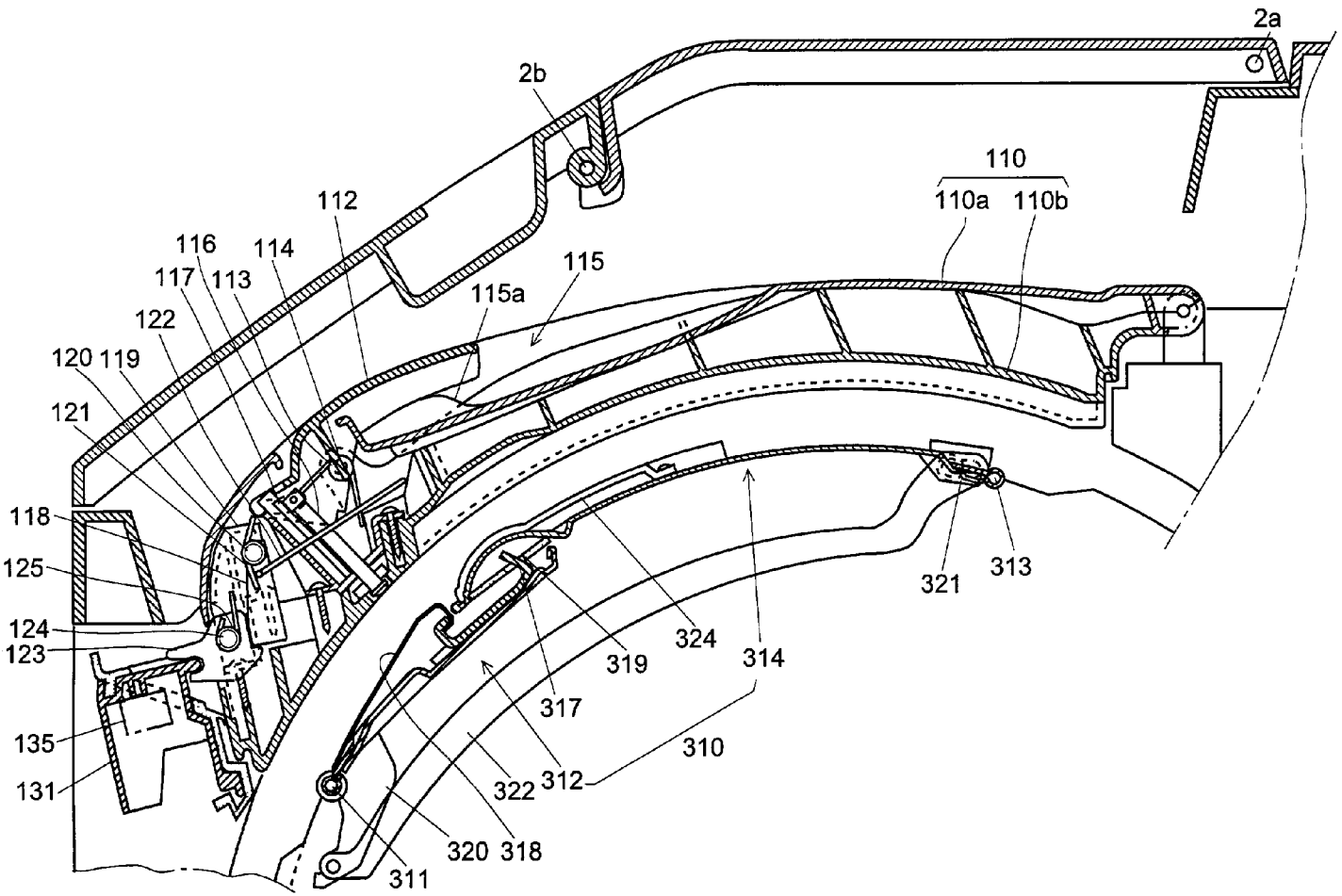
FIG. 14 is a vertical sectional view of a part around the throw-in opening of a washing machine as a second embodiment of the present invention, viewed from the right side.
Figure 15A:
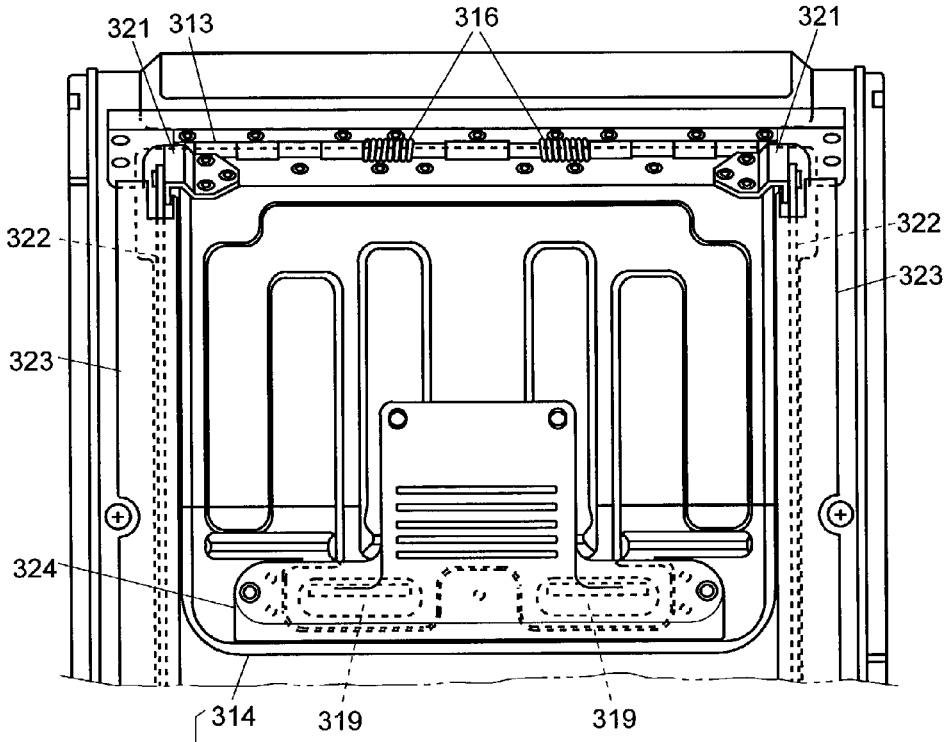
FIGS. 15A–B are plan views of the structure for opening and closing the drum door of the washing machine of the second embodiment.
Figure 15B:
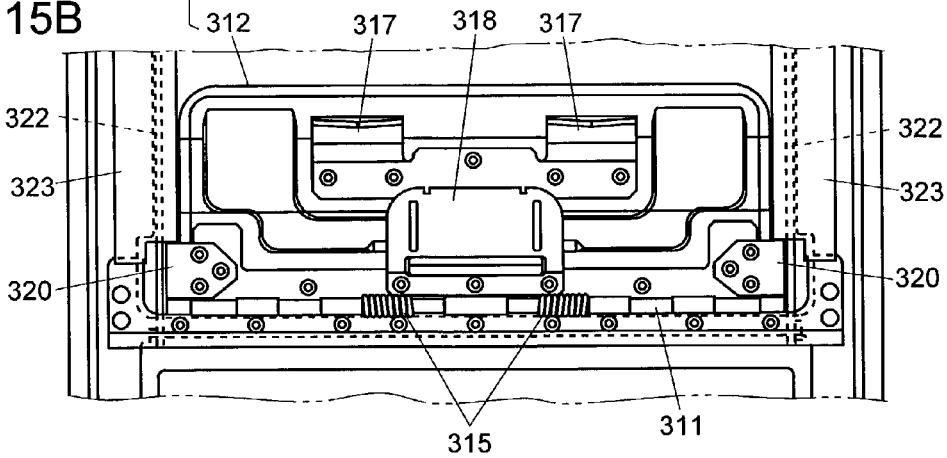

The construction of the drum door 310 is as follows. As shown in FIGS. 14 to 16, the drum door 310 is composed of a front-side door 312 and a rear-side door 314. The front-side door 312 is rotatable about a substantially horizontal front shaft 311 extending in the lateral direction, and the rear-side door 314 is rotatable about a substantially horizontal rear shaft 313 extending in the lateral direction. When the drum door 310 is closed, the end edge of the rear-side door 314 comes over the end edge of the front-side door 312. When the drum door 310 is opened, the two doors 312 and 314 open like a double door.

Figure 16A:
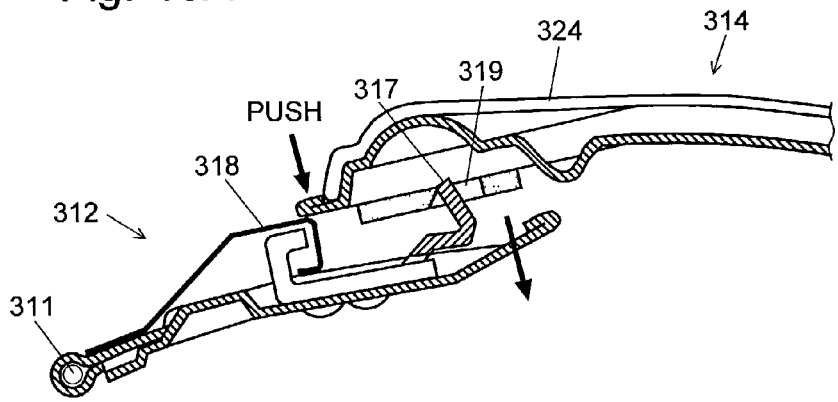
FIGS. 16A and 16B are vertical sectional views of a part of the washing machine of the first embodiment, viewed from the right side, showing the open/close motion of the drum door.
Figure 16B:
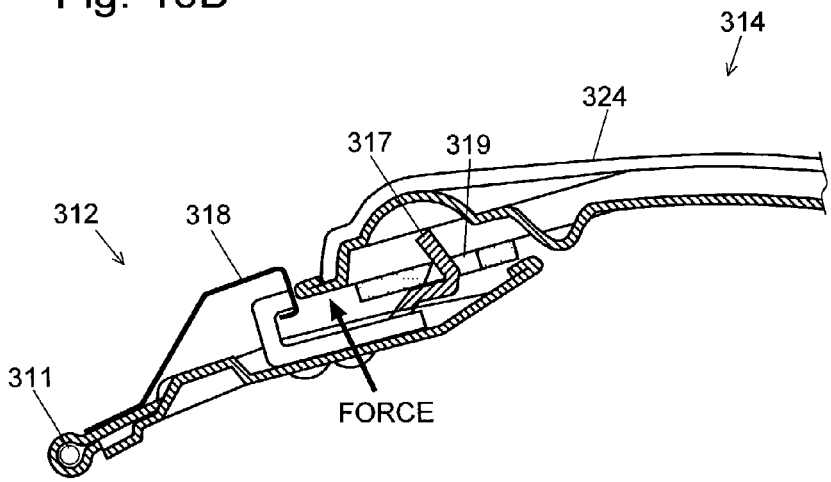

The front-side door 312 is forced into its opening direction (counterclockwise direction in FIG. 14) by a spring 315 wound on the front shaft 311, and the rear-side door 314 is forced into its opening direction (clockwise direction in FIG. 14) by a spring 316 wound on the rear shaft 313. The front-side door 312 has a pair of claws 317, right and left, directed upward on the overlapping part. The claws 317 are connected to a supporting plate 318 that functions like a spring. When the supporting plate 318 is pushed down, the claws 317 go down into the inside of the drum 23, and when the pushing force is removed, the claws 317 return to the original position. The rear-side door 314 has, on its overlapping part, a pair of engagement holes 319 to be engaged with the claws 317. A plastic protection cover 324 is riveted on the top of the rear-side door 314. The claws 317 and the engagement holes 319 function as the drum-door-latching mechanism. When the claws 317 are engaged with the engagement holes 319, the front-side door 312 and the rear-side door 314 are held in the position where they close the drum opening 300 (FIG. 16B). When the supporting plate 318 is pushed from above, the claws 317 and the engagement holes 319 are released from engagement (FIG. 16A), and the doors 312 and 314 are opened by the forces of the springs 315 and 316. When the claws 317 are engaged with the engagement holes 319, the tip of the claws 317 projecting from the engagement holes 319 are covered by the protection cover 324. Therefore, there is no possibility that the claws 317 contact the hand of the user when the user pushes the rear-side door 314 from above in order to close the drum door 310. Thus, a high degree of safety is achieved.

The front-side door 312 and the rear-side door 314 are linked to each other by curved linking elements 322 rotatably connected to a pair of hinge arms 320 and 321, over which a plastic cover 323 is placed. The function of the linking elements 322 is to make the two doors 312 and 314 linked while restraining their motions so that the front-side door 312 is always closed before the rear-side door 314 when the two doors 312 and 314 are closed from the opened position. By this construction, when the drum door 310 is closed, the end edge of the rear-side door 314 comes over the end edge of the front-side door 312. Thus, the engagement of the doors 312 and 314 is ensured.

The construction of the tub door 110 is described below. The tub door 110 is composed of a single door rotatable about a substantially horizontal shaft 111 extending in the lateral direction. The tub door 110 is forced into the opening direction (clockwise direction in FIG. 14) by a torsion coil spring (not shown) wound on the shaft 111. Inside the tub door 110, a tub-door-latching mechanism and an unlatching mechanism are formed. The tub-door-latching mechanism engages the edge of the front part of the tub 20 to keep the tub door 110 in the closed position. The unlatching mechanism actuates the tub-door-latching mechanism and the drum-door-latching mechanism to releases the doors from the latched positions. The main components of the tub-door-latching mechanism include an engaging cam 123 projecting from the front of the tub door 110, a clutch cam 118 for restraining the rotation of the engaging cam 123, and a projection 130 is fixed in the tub 20. The main components of the unlatching mechanism include an operation lever 112 placed on the top of the tub door 110, a rod 116, a guiding shaft 117, a traction bar 122, etc.

Figure 17:
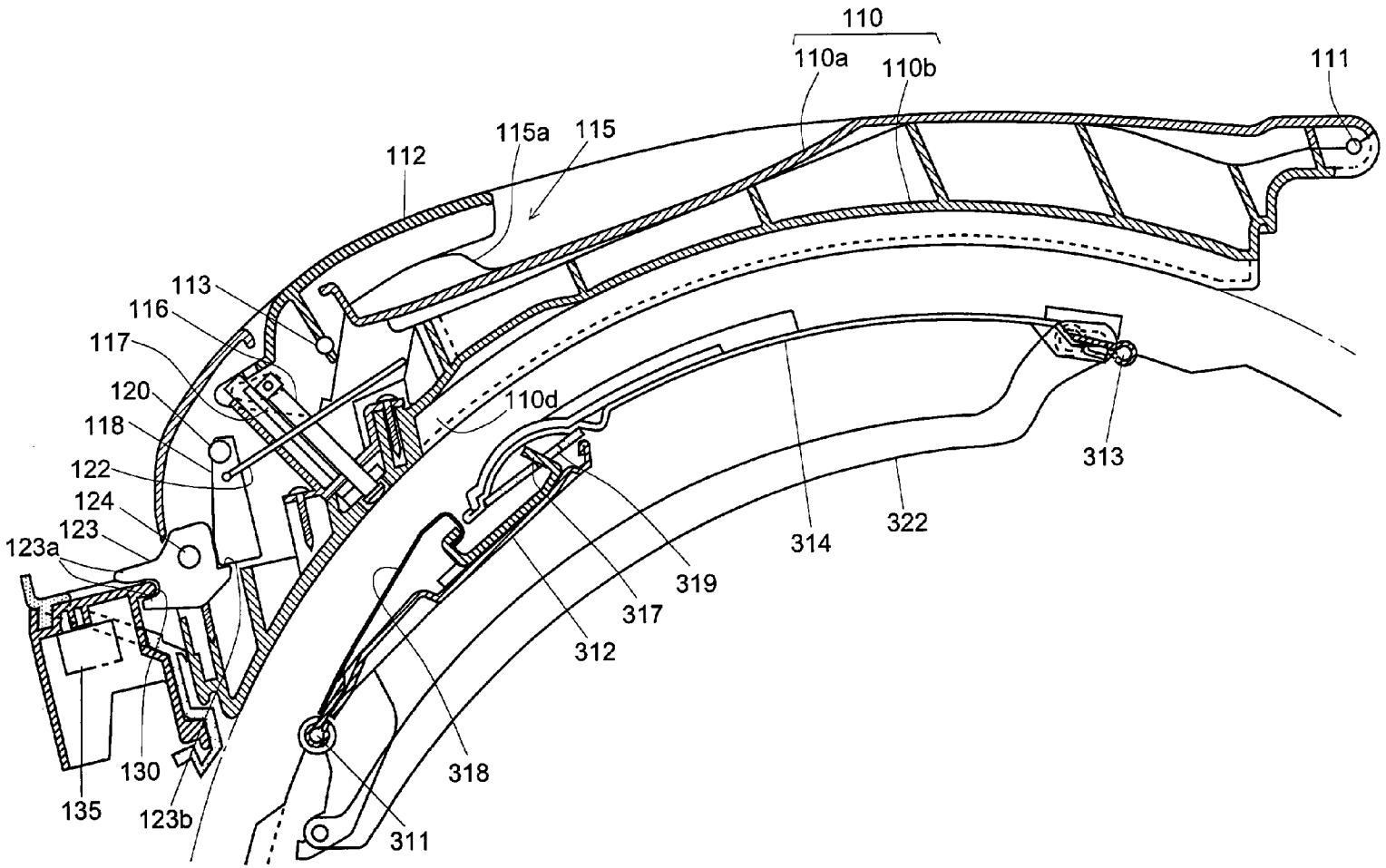
FIGS. 17 and 18 are vertical sectional views of a part of the washing machine of the first embodiment, viewed from the right side, showing the open/close motion of the tub door.
Figure 18:
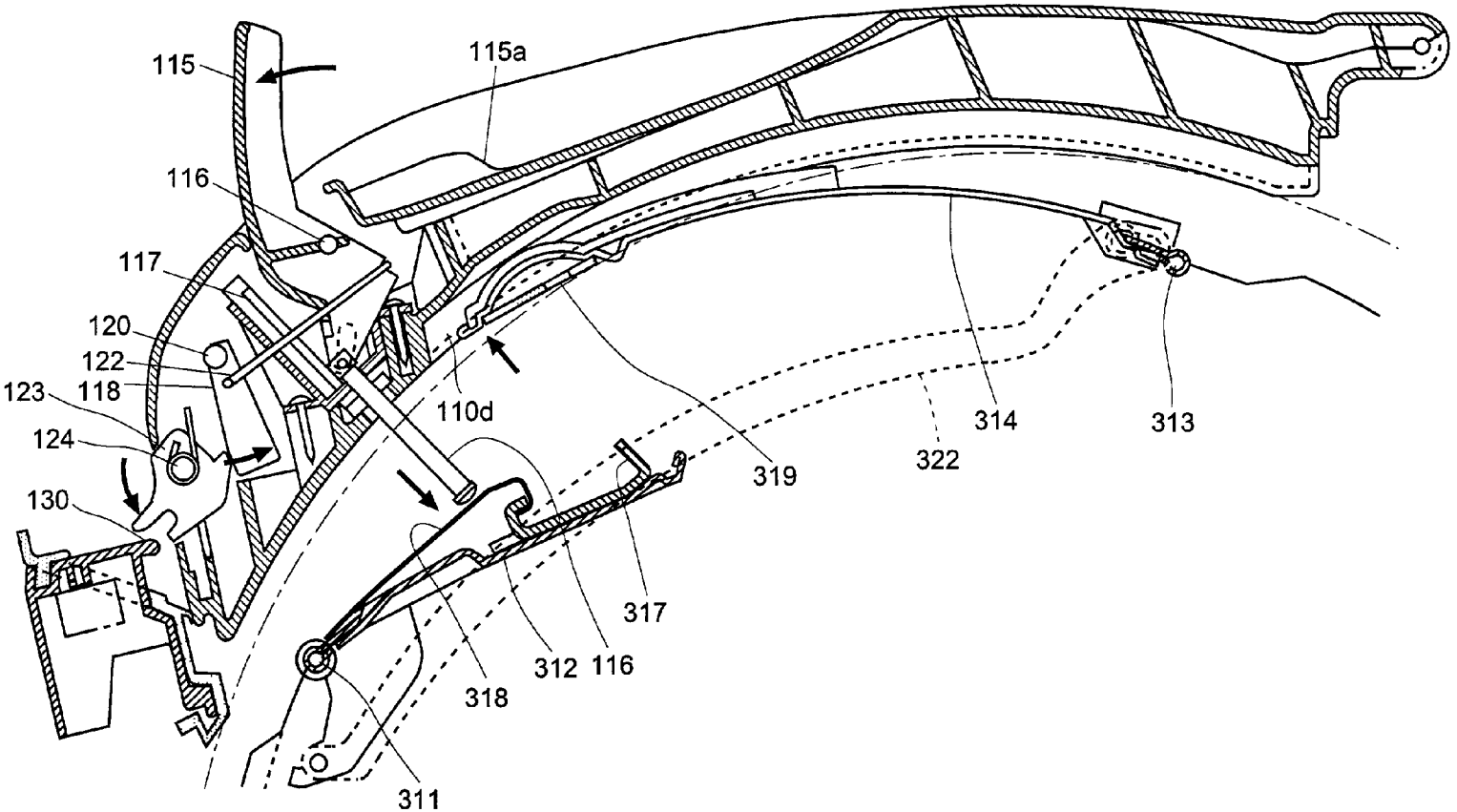

Explanations of the above components are as follows. The operation lever 112 as the operation mechanism is provided on the top outer door tub 110. The operation lever 112 is rotatable about a shaft 113, and is forced into clockwise direction in FIGS. 17 and 18 by a torsion coil spring 114. Behind the operation lever 112, a finger pull 115 is formed on the top of the tub door 110. The user should insert a finger or fingers into the finger pull 115 from behind, hook the operation lever 112 with a finger from below, and pull the operation lever 112 upright. When pulled upright, the operation lever 112 stands against the force of the spring 114 (FIG. 18). When the user removes the finger, the operation lever 112 immediately returns to the original position due to the force of the spring 114.

Figure 19:
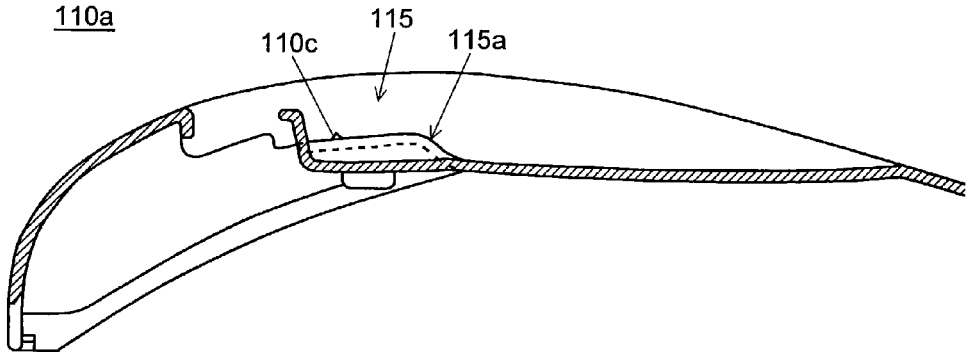
FIG. 19 is a vertical sectional view of a part of a member of the tub door of the washing machine of the second embodiment.

The housing of the tub door 110 is composed of an upper member 110*a* and a lower member 110*b*, each of which is a plastic molding. To produce this type of plastic member with a mold, it is necessary to form a mold gate through which molten plastic is poured into the mold. In the product obtained, a projection is formed at a position corresponding to the gate. Leaving this projection at a position that can be easily seen by the user will damage the appearance of the product. Therefore, the upper member 110*a* is designed so that the mold gate is located inside the finger pull 115. Thus, a projection 110*c* is formed on the lower wall of the finger pull 115, as shown in FIG. 19. Since this part is hidden by the operation lever 112, the projection does not mar the appearance. It is possible that the projection 110*c*, however, might hit the finger of the user during the operation of the operation lever 112. In view of this problem, the finger pull 115 has a slope 115*a* formed on the lower wall that gradually inclines from back to front, and the projection 110*c* is formed in front of the slope 115*a*, leaving a distance from the top of the slope 115*a*. With this construction, when the user inserts a finger into the finger pull 115 to pull the operation lever 112 upright, the back of the finger contacts the lower wall, and the fingertip goes obliquely upward along the slope 115*a*. Even when the finger is deeply inserted into the finger pull 115, the fingertip comes over the projection 110*c* without touching it. Thus, a high degree of safety is achieved.

Back to FIGS. 17 and 18 again, a rod 116 as the first moving part is provided in front of the operation lever 112. The rod 116, supported by a guide shaft 117, is directed to the inside of the tub 20 and movable back and forth. One end of the operation lever 112 is linked with the upper end of the rod 116. When the operation lever 112 is in the normal position, the rod 116 is in its highest position and does not project from the inner surface of the tub 20 (FIG. 17). When the operation lever 112 is pulled upright as shown in FIG. 18, the rod 116 is pushed down together with the rotation of the operation lever 112, and the lower end of the rod 116 projects into the tub 20. When the rod 116 fully projects while the drum 23 is in the predetermined stop position, the rod 116 contacts the supporting plate 318 of the front-side door 312 of the drum door 310 and pushes it down. This downward motion releases the claws 317 and the engagement holes 319 of the drum 23 from the engagement. In front of the guide shaft 117 is provided a clutch cam 118 rotatable about a shaft 120 formed on a clutch fixation plate 119. The clutch cam 118 is forced into the clockwise direction in FIGS. 17 and 18 by a torsion coil spring 121 wound on the shaft 120. Further, the clutch cam 118 is linked with the operation lever 112 by a traction bar 122, which corresponds to the second moving part. When the operation lever 112 is pulled upright as described above, the traction bar 122 is pulled backward, and the clutch cam 118 rotates in the counterclockwise direction against the force of the spring 121. In front of the clutch cam 118 is provided an engaging cam 123 rotatable about a shaft 124 formed on the clutch fixation plate 119. The engaging cam 123 is forced into the counterclockwise direction by a torsion coil spring 125. The engaging cam 123 has a biting part 123*a* at its front side and a step 123*b* at its rear side. The biting part 123*a* has upper and lower projections formed like a bill of a bird projecting from the front of the tub door 110. The step 123*b* is designed to engage with the clutch cam 118. A projection 130 is formed on an edge of the opening of the tub 20 opposite to the front edge of the tub door 110. The projection 130 is a part of a housing 131 to be described later, and also is a member of the tub-door-latching mechanism. The biting part 123*a* of the engaging cam 123 bites at the projection 130 to latch the tub door 110 in the closed position.

Next, the operation of opening and closing the tub door 110 and the drum door 310 with the lid 2 opened is described. It is assumed that at first the tub door 110 and the drum door 310 are latched in the closed positions, as shown in FIG. 17. In this state, the biting part 123*a* of the engaging cam 123 bites at the projection 130 on the tub 20, and the clutch cam 118 prevents the engaging cam 123 from rotation, and the traction bar 122 exerts no force on the clutch cam 118. When thus held in the closed position, the tub door 110 does not open even if an external force due to an extreme vibration or the like is exerted on it.

Next, in order to open the tub door 110, the user inserts a finger or fingers into the finger pull 115, and pulls the operation lever 112 upright as shown in FIG. 18. Then, the operation lever 112 rotates about the shaft 113, and the rod 116 descends together with the rotation of the operation lever 112. As described above, the rod 116 is located so that it contacts the supporting plate 318 of the front-side door 312 of the drum door 310 when it fully projects. Therefore, in the position as shown in FIG. 16B, the supporting plate 318 is pushed down by the rod 116, whereby the front-side door 312 is rotated downward about the front shaft 311. Then, the claws 317 come off the engagement holes 319, removing the force pulling the rear-side door 314 downward, and the rear-side door 314 rotates in the opening direction due to the force of the spring. Further, the front-side door 312 also attempts to open after the rear-side door 314. Also, during the rotation, the operation lever 112 pulls the traction bar 122 backward, whereby the clutch cam 118 is rotated about the shaft 120 in the counterclockwise direction against the force of the spring 121. Then, the clutch cam 118 comes off the step 123*b* of the engaging cam 123. The engaging cam 123, now being allowed to rotate, attempts to rotate in the counterclockwise direction due to the force of the spring 125. During this rotation, the engaging cam 123 moves upward, pushing the projection 130 down by the upper projection of the biting part 123*a*. Finally, the engaging cam 123 comes off the biting position, and the front end of the tub door 110 is slightly lifted. Thus, the pulling operation of the traction bar 122 corresponds to the releasing operation of the tub door 110 from the closed position. In the above process, which of the tub door 110 and the drum door 310 is unlatched earlier is determined by the timings of the projection of the rod 116 and the pulling of the traction bar 122, both occurring with the rotation of the operation lever 112. The washing machine of this embodiment is designed so that the drum door 310 is unlatched a little earlier than the tub door 110. With this design, the unlatching operation proceeds as follows.

While the user is pulling the operation lever 112, the drum door 310 is unlatched and, immediately after that, the rear-side door 314 and the front-side door 312 are lifted by the force of the spring, as described above. At this moment, the tub door 110 is not open yet because it is still latched or is in the process of the unlatching operation. Therefore, the two doors 312 and 314 of the drum door 310, lifted by the spring, contact the lower surface of the tub door 110. After the tub door 110 is unlatched, the user opens the tub door 110 backward. Then, forced by the spring 316, the rear-side door 314 rotates backward together with the outer door tub 110 in such a manner that it immediately follows the lower surface of the tub door 110. Also, with a little delay, the linking elements 322 actuate the front-side door 312 to rotate forward. Thus, by the present design, the rear-side door 314 of the drum door 310 is opened together with the opening motion of the tub door 110 and, finally, the two doors 312 and 314 of the drum door 310 are opened like a double door. It should be noted that users usually open the tub door 110 a little later than operating the operation lever 112. Therefore, in practice, even if the drum door 310 and the tub door 110 are unlatched almost at the same time, the rear-side door 314 of the drum door 310 is opened together with the opening motion of the tub door 110.

The lower surface of the lower member 110*b* of the tub door 110 has a recess 110*d* for receiving the rear-side door 314. When the rear-side door 314 is opened while the tub door 110 is closed, the end edge of the rear-side door 314 enters the recess 110*d*, as shown in FIG. 18. For example, when the drum door 310 is accidentally unlatched by vibration or the like, the end edge of the rear-side door 314 enters the recess 110*d*. If the drum 23 is driven with the rear-side door 314 in the above state, the end edge of the rear-side door 314 collides with the step of the recess 110*d*, and the motor 30 becomes overloaded. Thus, the abnormality can be detected based on the loading state of the motor 30.

After, for example, loading the laundry into the drum 23, the user closes the rear-side door 314 of the drum door 310 by rotating frontward the rear-side door 314 that is then standing with a slight inclination backward. There, because of the function of the linking elements 322, the front-side door 312 rotates ahead of the rear-side door 314 and reaches the closing position of the drum opening 300, and then the rear-side door 314 comes over the front-side door 312. After that, when the user pushes the rear door 314 at the protection cover 324, the claws 317 engage with the engagement holes 319. Thus, the drum door 310 is latched. At this moment, the user can hardly fail to see any part of the laundry hanging out and caught by the drum door 310. After closing the drum door 310, the user rotates the tub door 110 forward until the upper projection of the biting part 123*a* of the engaging cam 123 contacts the projection, and further pushes the tub door 110 down. This makes the engaging cam 123 rotate in the clockwise direction against the force of the spring 125. Finally, the clutch cam 118 engages with the step 123*b* of the engaging cam 123, whereby the engaging cam 123 is locked. Thus, also the tub door 110 is latched in the closed position.

Figure 20A:
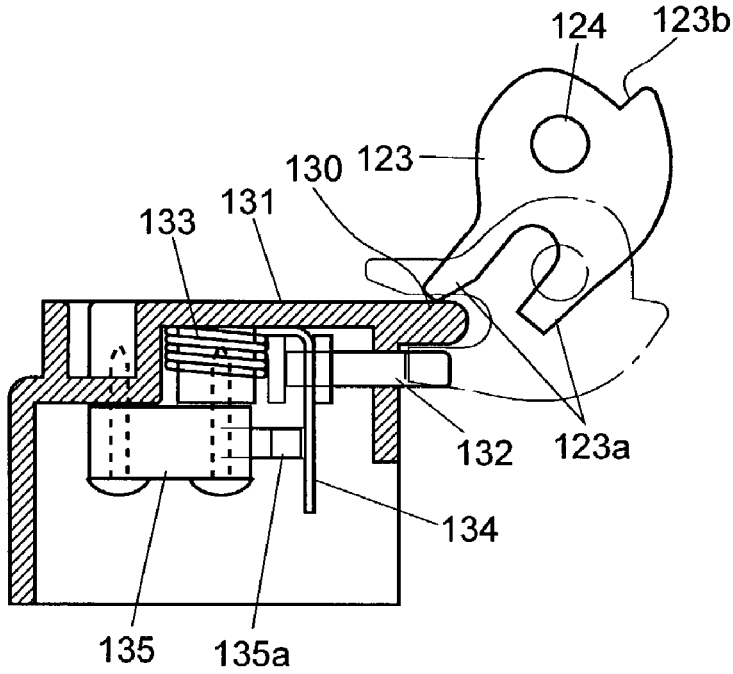
FIG. 20A is a vertical sectional view of the mechanism for detecting the open/close state of the tub door of the washing machine of the second embodiment, viewed from the right side.
Figure 20B:
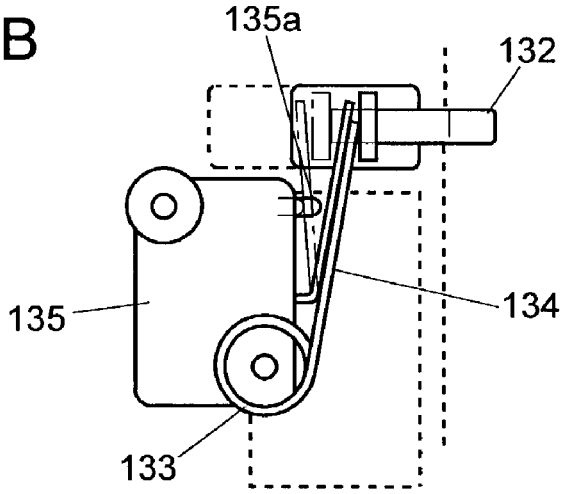
FIG. 20B is a plan view of a part of the mechanism.

With the washing machine of the second embodiment, the tub door 110 and the drum door 310 are opened or closed as described above. The open/closed state of the tub door 110 is detected by a mechanism constructed in the housing 131 having the above-described projection 130. The housing 131 is fixed to the tub 20 opposite to the front edge of the tub door 110, as shown in FIGS. 20A and 20B.

In the housing 131 is provided with a pin 132 slidable in the front-back direction. The tip of the pin 132 protrudes from the wall of the housing 131 backward, or toward the front of the tub door 110. The pin 132 is pushed toward the tub door 110 by a movable plate 134 forced by a torsion coil spring 133. A switch 135 is placed in front of the movable plate 134.

When the tub door 110 is opened, no force is exerted on the pin 132 from behind (from the right side in FIG. 20). Therefore, the force of the spring 133 projects the pin 132 toward the tub door 110, and the movable plate 134 is off the needle 135*a* of the switch 135. When the tub door 110 is closed and latched as described above, the lower projection of the biting part 123*a* of the engaging cam 123 pushes the pin 132 into the housing 131 against the force of the spring 133. The pin 132 pushes the movable plate 134, which in turn pushes the needle 135*a* of the switch 135. Thus, the switch 135 is turned from close to open (or vice versa). Thus, by the help of the external torsion coil spring 133, the opening and closing of the switch 135 is secured.

Finally, it should be noted that the above embodiments are mere examples and can be altered or modified in various manners within the spirit and scope of the present invention.

What is claimed is:

1. A drum type washing machine in which a drum with a substantially cylindrical peripheral wall is mounted to rotate about a horizontal or inclined axis in a tub enclosed in a housing, comprising:

a) a throw-in opening formed in a top of the housing, which can be closed by a lid;

b) a tub opening formed in a peripheral wall of the tub placed right under the throw-in opening, which can be closed by a tub door;

c) a drum opening formed in the peripheral wall of the drum, which can be closed by a drum door;

d) a drum-door-latching mechanism configured to hold the drum door in a closed position of the drum door;

e) a drum position determiner configured to stop the drum in such a position that the drum opening substantially coincides with the tub opening; and f) a door-linking mechanism configured to unlatch the drum-door-latching mechanism and configured to make the drum door open together with an opening motion of the tub door when the drum is stopped with both the tub door and the drum door closed and the lid is opened by a user and then the tub door is opened by the user.

2. The drum type washing machine according to claim 1, wherein the door-linking mechanism is constructed so that it makes the drum door close together with a closing motion of the tub door when both the tub door and the drum door are open.

3. The drum type washing machine according to claim 1, wherein the drum door is configured with a biasing force in an opening direction thereof, the biasing force having a magnitude that is sufficient to make the drum door follow the tub door during the opening motion of the tub door.

4. The drum type washing machine according to claim 3, wherein the magnitude of the biasing force is sufficient to support the drum door and the tub door in a slightly open position.

5. The drum type washing machine according to claim 1, wherein:

the drum is mounted to rotate about an axis extending in a lateral direction;

the housing has a slope declining from the top to the front;

the throw-in opening is formed to extend over the slope;

the lid is a foldable structure composed of at least a front part and a rear part hinged to each other at a bent part of the top of the housing, where the bent part corresponds to a rear end of the slope; and the lid stands behind the throw-in opening in a folded position when it is opened.

6. The drum type washing machine according to claim 1, wherein:

the drum is mounted to rotate about an axis extending in a lateral direction;

the housing has a slope declining from the top to the front;

the throw-in opening is formed to extend over the slope; and an control panel with control keys are placed on the slope.

7. The drum type washing machine according to claim 6, wherein:

the lid for closing the throw-in opening, the control panel with the control keys, and a detergent container which is drawable frontward are arranged so that the lid is located at the center and the control panel and the detergent container are located on both sides of the lid, respectively, or on one side of the lid.

8. The drum type washing machine according to claim 1, further comprising:

a tub-door-latching mechanism configured to hold the tub door in a closed position;

a forcing mechanism configured to force the drum door in an opening direction of the drum door, the forcing mechanism being part of the door-linking mechanism;

an operation mechanism, provided in the tub door, to be operated by a user; and an unlatching mechanism configured to actuate the tub-door-latching mechanism and the drum-door-latching mechanism in response to an operation of the operation mechanism so that the drum door is released from its latched state and the tub door is released from its latched state at the same time or with a slight delay.

9. The drum type washing machine according to claim 8, wherein the tub-door-latching mechanism and the drum-door-latching mechanism are constructed so that the tub door and the drum door independently move from opened positions to the closed and latched positions.

10. The drum type washing machine according to claim 8, wherein the unlatching mechanism includes:

a first moving part which projects into or withdraws from an inside of the drum together with the operation of the operation mechanism, and contacts the drum-door-latching mechanism to release a latch when it fully projects; and a second moving part which actuates the drum-door-latching mechanism together with the operation of the operation mechanism to release a latch.

11. The drum type washing machine according to claim 1, further comprising a stopper which contacts an edge of the drum door when the drum attempts to rotate with the drum door opened.

12. A drum type washing machine wherein a drum with a substantially cylindrical peripheral wall is mounted to rotate about an axis extending in a lateral direction in a tub enclosed in a housing, comprising:

a) a throw-in opening formed in a top of the housing, which can be closed by a lid;

b) a tub opening formed in a peripheral wall of the tub placed right under the throw-in opening, which can be closed by a tub door;

c) a drum opening formed in the peripheral wall of the drum;

d) a drum door configured to close the drum opening, composed of a double door having two door elements opening frontward and backward, respectively, each door element being forced into its opening direction, and an engaging mechanism configured to hold the drum door in a closed position;

e) a drum position determiner configured to stop the drum in such a position that the drum opening substantially coincides with the tub opening; and f) a drum-door-linking mechanism having at least one moving part movable back and forth between the tub and the drum, where the moving part makes a motion when an operation to open the tub door is performed, and the motion of the moving part releases the engaging mechanism from engagement so that the drum door is opened.

13. The drum type washing machine according to claim 12, wherein drum-door-linking mechanism is constructed so that a closing operation of the tub door makes the moving part move to bring the engaging mechanism into engagement so that the drum door is closed.

14. A drum type washing machine wherein a drum with a substantially cylindrical peripheral wall is mounted to rotate about a horizontal or inclined axis in a tub enclosed in a housing, comprising:

a) a throw-in opening formed in a top of the housing, which can be closed by a lid;

b) a tub opening formed in a peripheral wall of the tub right under the throw-in opening, which can be closed by a tub door;

c) a drum opening formed in the peripheral wall of the drum;

d) a drum door configured to close the drum opening, composed of a double door having two door elements, where the two door elements are engaged with each other at overlapping parts when the drum door is closed; and e) a linking mechanism configured to link the two door elements of the drum door to concurrently move the two door elements so that the two door elements maintain a preset relationship while being opened or closed.

15. The drum type washing machine according to claim 14, wherein the linking mechanism is provided inside the drum.

16. The drum type washing machine according to claim 14, wherein the linking mechanism links the two door elements so that when the two door elements are closed from the open position, one element always close before the other element.

* * * * *